US010012354B2

(12) United States Patent
Bernard et al.

(10) Patent No.: US 10,012,354 B2
(45) Date of Patent: Jul. 3, 2018

(54) ADJUSTABLE RETROFIT LED TROFFER

(71) Applicant: CREE, INC., Durham, NC (US)

(72) Inventors: Randy Bernard, Cary, NC (US); Gary Trott, Eatonton, GA (US); Nathan Snell, Raleigh, NC (US); William L. Dungan, Cary, NC (US)

(73) Assignee: CREE, INC., Durham, NC (US)

( * ) Notice: Subject to any disclaimer, the term of this patent is extended or adjusted under 35 U.S.C. 154(b) by 228 days.

(21) Appl. No.: 14/752,684

(22) Filed: Jun. 26, 2015

(65) Prior Publication Data

US 2016/0377261 A1 Dec. 29, 2016

(51) Int. Cl.
*F21V 7/18* (2006.01)
*F21S 8/02* (2006.01)
(Continued)

(52) U.S. Cl.
CPC ..... *F21S 8/026* (2013.01); *F21V 7/005* (2013.01); *F21V 17/02* (2013.01); *F21V 23/006* (2013.01); *F21V 5/04* (2013.01); *F21V 13/04* (2013.01); *F21V 15/015* (2013.01); *F21V 17/104* (2013.01); *F21V 23/02* (2013.01); *F21Y 2115/10* (2016.08)

(58) Field of Classification Search
CPC ..... F21S 8/026; F21V 7/005; F21V 17/02; F21V 23/006; F21V 5/04
See application file for complete search history.

(56) References Cited

U.S. PATENT DOCUMENTS

D85,382 S 10/1931 Guth ..... D26/24
2,356,654 A 8/1944 Cullman ..... 362/223
(Continued)

FOREIGN PATENT DOCUMENTS

CN 1762061 4/2006
CN 1934389 3/2007
(Continued)

OTHER PUBLICATIONS

Office Action from U.S. Appl. No. 13/464,745; dated Mar. 1, 2016.
(Continued)

*Primary Examiner* — Anabel Ton
(74) *Attorney, Agent, or Firm* — Koppel, Patrick, Heybi & Philpott

(57) ABSTRACT

A direct troffer-style fixture for solid state light sources for use in these fixtures. Embodiments of the present invention provide a direct troffer-style fixture that is particularly well-suited for retrofit structures. The fixture comprises a retrofit troffer assembly that is removably attached within a T grid or pan structure. The retrofit fixture can be installed in two pieces: a first including a lens structure, a back reflector and 2 end reflectors; and the second component including a second portion of the back reflector. An interior space created by the lens structure houses light emitters and in some embodiments, a light engine and/or additional electronics. One or both of the end reflectors may be movable, slidable and/or rotatable, to accommodate installation. The back reflector covers most of the interior surfaces of the troffer fixture to direct more light out of the fixture.

28 Claims, 9 Drawing Sheets

(51) Int. Cl.

| | |
|---|---|
| ***F21V 7/00*** | (2006.01) |
| ***F21V 17/02*** | (2006.01) |
| ***F21V 23/00*** | (2015.01) |
| *F21V 5/04* | (2006.01) |
| *F21V 15/015* | (2006.01) |
| *F21V 13/04* | (2006.01) |
| *F21V 17/10* | (2006.01) |
| *F21V 23/02* | (2006.01) |
| *F21Y 115/10* | (2016.01) |

(56) References Cited

U.S. PATENT DOCUMENTS 2,675,766 A 4/1954 Frederick
3,302,918 A 2/1967 Cohen
3,381,124 A 4/1968 Eisenberg ..... 362/354
3,743,826 A 7/1973 Halfaker
4,044,246 A 8/1977 Docimo
4,302,798 A 11/1981 Sit
4,939,627 A 7/1990 Herst et al. ..... 362/299
5,025,356 A 6/1991 Gawad ..... 362/221
5,526,190 A 6/1996 Hubble, III ..... 347/102
5,546,291 A 8/1996 Simes
5,823,663 A 10/1998 Bell et al. ..... 362/362
D407,473 S 3/1999 Wimbock ..... D23/328
6,079,851 A 6/2000 Altman
6,102,550 A 8/2000 Edward, Jr.
6,127,783 A 10/2000 Pashley
6,155,699 A 12/2000 Miller et al. ..... 362/293
6,210,025 B1 4/2001 Schmidt et al. ..... 362/362
6,234,643 B1 5/2001 Lichon, Jr. ..... 362/147
6,382,817 B1 * 5/2002 Chelf ..... F21S 8/031 362/217.07
6,523,974 B2 2/2003 Engel ..... 362/224
6,545,216 B1 4/2003 Bell
6,578,979 B2 6/2003 Truttmann-Battig ..... 362/92
6,598,998 B2 7/2003 West ..... 257/E33.073
D496,121 S 9/2004 Santoro ..... D26/74
6,871,983 B2 3/2005 Jacob et al. ..... 362/364
6,948,838 B2 9/2005 Kunstler ..... 362/237
6,951,415 B2 10/2005 Amano ..... 362/297
7,021,797 B2 4/2006 Minano et al. ..... 362/355
7,025,477 B2 4/2006 Blessing
7,049,761 B2 5/2006 Timmermans et al. ..... 315/246
7,063,449 B2 6/2006 Ward ..... 345/102
7,102,172 B2 9/2006 Lynch
7,111,969 B2 9/2006 Bottesch ..... 362/299
7,125,146 B2 10/2006 Willis
7,175,296 B2 2/2007 Cok ..... 362/147
7,213,940 B1 5/2007 Van de Ven et al. ..... 362/231
7,217,004 B2 5/2007 Park et al. ..... 362/240
7,237,924 B2 7/2007 Martineau et al. ..... 362/231
D556,358 S 11/2007 Santoro ..... D26/74
7,338,182 B1 3/2008 Hastings et al. ..... 362/150
7,341,358 B2 3/2008 Hsieh ..... 362/97.1
7,374,327 B2 5/2008 Schexnaider
7,510,299 B2 3/2009 Timmermans et al. ..... 362/225
7,520,636 B2 4/2009 Van der Poel ..... 362/290
D593,246 S 5/2009 Fowler et al. ..... D26/76
7,559,672 B1 7/2009 Parkyn et al. ..... 362/244
7,594,736 B1 9/2009 Kassay et al. ..... 362/225
D604,446 S 11/2009 Fowler et al. ..... D26/76
7,614,769 B2 11/2009 Sell
7,618,157 B1 11/2009 Galvez et al. ..... 362/294
7,618,160 B2 11/2009 Chinniah et al. ..... 362/326
D608,932 S 1/2010 Castelli ..... D26/76
7,654,688 B2 2/2010 Li
7,654,702 B1 2/2010 Ding et al.
7,661,844 B2 2/2010 Sekiguchi et al. ..... 362/249.02
D611,183 S 3/2010 Duarte ..... D26/76
7,670,021 B2 3/2010 Chou
7,674,005 B2 3/2010 Chung et al. ..... 362/223
7,686,470 B2 3/2010 Chiang ..... 362/147
7,686,484 B2 3/2010 Heiking et al. ..... 362/375
7,712,918 B2 5/2010 Siemiet et al. ..... 362/241
7,722,220 B2 5/2010 Van de Ven ..... 362/294
7,722,227 B2 5/2010 Zhang et al. ..... 362/364
D617,487 S 6/2010 Fowler et al. ..... D26/76
7,768,192 B2 8/2010 Van de Ven et al. ..... 313/503
7,771,085 B2 8/2010 Kim
7,794,114 B2 9/2010 Medendorp
7,810,736 B2 10/2010 Smith
7,815,338 B2 10/2010 Siemiet et al. ..... 362/218
7,828,465 B2 11/2010 Roberts
7,828,468 B2 11/2010 Mayfield et al. ..... 362/342
7,854,616 B2 12/2010 Janos
D633,247 S 2/2011 Kong et al. ..... D26/88
7,906,793 B2 3/2011 Negley
7,918,591 B2 4/2011 Lynch
7,922,354 B2 4/2011 Everhart ..... 362/235
7,926,982 B2 4/2011 Liu ..... 362/294
7,950,832 B2 5/2011 Tanaka
7,959,332 B2 6/2011 Tickner
7,988,321 B2 8/2011 Wung et al. ..... 362/218
7,988,335 B2 8/2011 Liu et al. ..... 362/294
7,991,257 B1 8/2011 Coleman ..... 264/1.24
7,993,034 B2 8/2011 Wegner ..... 362/296.05
8,038,314 B2 10/2011 Ladewig
8,058,659 B2 11/2011 Bisberg
8,070,326 B2 12/2011 Lee ..... 362/307
8,070,328 B1 * 12/2011 Knoble ..... F21V 3/00 362/245
D653,376 S 1/2012 Kong et al. ..... D26/76
8,092,043 B2 1/2012 Lin et al. ..... 362/249.02
8,092,049 B2 1/2012 Kinnune et al. ..... 362/294
8,096,671 B1 1/2012 Cronk ..... 362/147
D657,488 S 4/2012 Lown et al. ..... D26/120
8,162,504 B2 4/2012 Zhang et al. ..... 362/217
8,186,855 B2 5/2012 Wassel et al. ..... 362/373
8,197,086 B2 6/2012 Watanabe et al. ..... 362/218
8,201,968 B2 6/2012 Maxik et al.
8,215,799 B2 7/2012 Vanden Eynden et al. .. 362/294
8,246,219 B2 8/2012 Teng et al. ..... 362/311.03
8,256,927 B2 9/2012 Hu et al. ..... 362/294
8,287,160 B2 10/2012 Shen
D670,849 S 11/2012 Lay et al. ..... D26/74
8,317,354 B2 11/2012 Gassner et al. ..... 362/147
D676,848 S 4/2013 Pickard et al. ..... D26/74
8,410,514 B2 4/2013 Kim ..... 257/99
D684,291 S 6/2013 Goelz et al. ..... D26/74
8,523,383 B1 * 9/2013 Grigore ..... F21S 8/026 362/217.13
8,556,452 B2 10/2013 Simon ..... 362/217.07
8,591,058 B2 11/2013 Concepcion ..... 362/231
8,591,071 B2 11/2013 Hochstein ..... 362/294
8,602,601 B2 12/2013 Khazi et al. ..... 362/249.02
8,616,723 B2 12/2013 Zhang ..... 362/218
D698,975 S 2/2014 Blessitt et al. ..... D26/74
8,641,243 B1 2/2014 Rashidi ..... 362/373
D701,988 S 4/2014 Clements ..... D26/74
8,696,154 B2 4/2014 Hutchens ..... 362/217.05
8,702,264 B1 4/2014 Rashidi ..... 362/147
8,764,244 B2 7/2014 Jeon ..... 362/218
8,789,963 B2 * 7/2014 Whitfield ..... F21L 4/00 362/109
D714,988 S 10/2014 Park et al. ..... D26/74
8,894,247 B2 * 11/2014 Kim ..... F21S 8/026 361/697
D721,198 S 1/2015 Glasbrenner ..... D26/76
9,010,956 B1 4/2015 Davis
9,052,075 B2 6/2015 Demuynck et al.
2003/0063476 A1 4/2003 English et al.
2004/0001344 A1 1/2004 Hecht ..... 362/555
2004/0085779 A1 5/2004 Pond et al. ..... 362/516
2004/0100796 A1 5/2004 Ward
2004/0160766 A1 * 8/2004 Schultz ..... F21V 15/01 362/220
2004/0240230 A1 12/2004 Kitajima ..... 362/558
2005/0180135 A1 8/2005 Mayer ..... 362/240
2005/0264716 A1 12/2005 Kim et al.
2005/0281023 A1 12/2005 Gould ..... 362/217
2006/0221611 A1 10/2006 No ..... 362/247
2006/0245208 A1 11/2006 Sakamoto
2006/0262521 A1 11/2006 Piepgras et al. ..... 362/149

(56) References Cited

U.S. PATENT DOCUMENTS

| | | | | |
|---|---|---|---|---|
| 2006/0279671 | A1 | 12/2006 | Han | |
| 2006/0291206 | A1 | 12/2006 | Angelini et al. | 362/244 |
| 2007/0070625 | A1 | 3/2007 | Bang | 362/240 |
| 2007/0109779 | A1 | 5/2007 | Sekiguchi et al. | |
| 2007/0115670 | A1 | 5/2007 | Roberts et al. | |
| 2007/0115671 | A1 | 5/2007 | Roberts et al. | |
| 2007/0133215 | A1* | 6/2007 | Mayfield, III | F21S 8/04 362/382 |
| 2007/0183148 | A1* | 8/2007 | Mayfield, III | F21V 5/02 362/223 |
| 2007/0211457 | A1 | 9/2007 | Mayfield et al. | 362/223 |
| 2007/0230172 | A1 | 10/2007 | Wang | |
| 2007/0253205 | A1 | 11/2007 | Welker | 362/373 |
| 2007/0297181 | A1 | 12/2007 | Mayfield et al. | 362/342 |
| 2008/0019147 | A1 | 1/2008 | Erchak | 362/607 |
| 2008/0037284 | A1 | 2/2008 | Rudisill | 362/629 |
| 2008/0049422 | A1 | 2/2008 | Trenchard et al. | 362/238 |
| 2008/0122364 | A1 | 5/2008 | McClellan | |
| 2008/0170398 | A1 | 7/2008 | Kim | |
| 2008/0232093 | A1 | 9/2008 | Kim | 362/147 |
| 2008/0232116 | A1 | 9/2008 | Kim | |
| 2008/0278943 | A1 | 11/2008 | Van der Poel | 362/240 |
| 2008/0303977 | A1 | 12/2008 | Sekiguchi | |
| 2009/0034247 | A1 | 2/2009 | Boyer | 362/225 |
| 2009/0073693 | A1 | 3/2009 | Nall | 362/249.02 |
| 2009/0161356 | A1 | 6/2009 | Negley et al. | 362/231 |
| 2009/0168439 | A1 | 7/2009 | Chiang | 362/404 |
| 2009/0196024 | A1 | 8/2009 | Heiking et al. | 362/150 |
| 2009/0225543 | A1 | 9/2009 | Roberts et al. | |
| 2009/0237958 | A1 | 9/2009 | Kim | |
| 2009/0262543 | A1 | 10/2009 | Ho | 362/373 |
| 2009/0296388 | A1 | 12/2009 | Wu et al. | 362/235 |
| 2009/0310354 | A1 | 12/2009 | Zampini et al. | 362/235 |
| 2009/0323334 | A1 | 12/2009 | Roberts et al. | |
| 2010/0039579 | A1 | 2/2010 | Park | |
| 2010/0061108 | A1 | 3/2010 | Zhang et al. | 362/364 |
| 2010/0097794 | A1 | 4/2010 | Teng et al. | 362/231 |
| 2010/0103678 | A1 | 4/2010 | Van de Ven et al. | 362/294 |
| 2010/0110679 | A1 | 5/2010 | Teng et al. | |
| 2010/0172133 | A1 | 7/2010 | Liu | 362/235 |
| 2010/0177532 | A1 | 7/2010 | Simon et al. | 362/555 |
| 2010/0188609 | A1 | 7/2010 | Matsuki et al. | |
| 2010/0253591 | A1 | 10/2010 | Hwu et al. | 345/1.3 |
| 2010/0254128 | A1 | 10/2010 | Pickard et al. | 362/231 |
| 2010/0254145 | A1 | 10/2010 | Yamaguchi | |
| 2010/0254146 | A1 | 10/2010 | McCanless | |
| 2010/0270903 | A1 | 10/2010 | Jao et al. | 313/46 |
| 2010/0277905 | A1 | 11/2010 | Janik et al. | 362/235 |
| 2010/0277934 | A1 | 11/2010 | Oquendo, Jr. | 362/433 |
| 2010/0295468 | A1 | 11/2010 | Pedersen et al. | 315/294 |
| 2010/0302778 | A1 | 12/2010 | Dabiet | |
| 2010/0327768 | A1 | 12/2010 | Kong et al. | 315/294 |
| 2011/0032714 | A1 | 2/2011 | Chang | 362/373 |
| 2011/0043132 | A1 | 2/2011 | Kim et al. | 362/235 |
| 2011/0141722 | A1 | 6/2011 | Acampora et al. | 362/218 |
| 2011/0141734 | A1 | 6/2011 | Li et al. | 362/235 |
| 2011/0156584 | A1 | 6/2011 | Kim | 315/32 |
| 2011/0164417 | A1 | 7/2011 | Huang | 362/235 |
| 2011/0175533 | A1 | 7/2011 | Homan | 315/130 |
| 2011/0199005 | A1 | 8/2011 | Bretschneider et al. | |
| 2011/0199769 | A1 | 8/2011 | Bretschneider et al. | |
| 2011/0246146 | A1 | 10/2011 | Kauffman et al. | 703/2 |
| 2011/0255292 | A1 | 10/2011 | Shen | 362/311 |
| 2011/0267810 | A1 | 11/2011 | Higman et al. | 362/218 |
| 2011/0286225 | A1 | 11/2011 | Konishi | |
| 2011/0305024 | A1 | 12/2011 | Chang | 362/294 |
| 2012/0033420 | A1 | 2/2012 | Kim et al. | 362/235 |
| 2012/0038289 | A1 | 2/2012 | Jee et al. | 315/291 |
| 2012/0051041 | A1 | 3/2012 | Edmond et al. | 362/231 |
| 2012/0120658 | A1 | 5/2012 | Wilk | |
| 2012/0127714 | A1 | 5/2012 | Rehn | |
| 2012/0134146 | A1 | 5/2012 | Smith | 362/225 |
| 2012/0140442 | A1 | 6/2012 | Woo | 362/95 |
| 2012/0140461 | A1 | 6/2012 | Pickard | |
| 2012/0206926 | A9 | 8/2012 | Chou | |
| 2013/0235568 | A1 | 9/2013 | Green et al. | 362/218 |
| 2013/0242550 | A1 | 9/2013 | Suen | |
| 2013/0258652 | A1 | 10/2013 | Hsieh | 362/225 |
| 2014/0265930 | A1 | 9/2014 | Harris | 315/307 |
| 2015/0016100 | A1 | 1/2015 | Ishii | 362/223 |

FOREIGN PATENT DOCUMENTS

| | | | |
|---|---|---|---|
| CN | 1963289 | A | 5/2007 |
| CN | 101188261 | | 5/2008 |
| CN | 201069133 | | 6/2008 |
| CN | 101776254 | | 7/2010 |
| CN | 101776254 | A | 7/2010 |
| CN | 101790660 | | 7/2010 |
| CN | 101790660 | A | 7/2010 |
| CN | 202580962 | | 12/2012 |
| DE | 102007030186 | | 1/2008 |
| DE | 102007030186 | | 1/2009 |
| DE | 202010001832 | | 7/2010 |
| EP | 1298383 | | 4/2003 |
| EP | 1298383 | A2 | 4/2003 |
| EP | 1357335 | A2 | 10/2003 |
| EP | 1653254 | | 3/2006 |
| EP | 1737051 | | 12/2006 |
| EP | 1847762 | | 10/2007 |
| EP | 1847762 | A2 | 10/2007 |
| EP | 1860467 | | 11/2007 |
| EP | 1950491 | | 7/2008 |
| EP | 2287520 | A2 | 2/2011 |
| EP | 2290690 | A2 | 3/2011 |
| EP | 2636945 | A2 | 9/2013 |
| GB | 774198 | | 5/1957 |
| JP | 1069809 | | 3/1998 |
| JP | 2002344027 | | 11/2002 |
| JP | U3 097327 | | 8/2003 |
| JP | 2004140324 | | 5/2004 |
| JP | 2004345615 | | 12/2004 |
| JP | 2004345615 | A | 12/2004 |
| JP | 2006173624 | | 6/2006 |
| JP | 2008147044 | | 6/2008 |
| JP | 3151501 | U | 6/2009 |
| JP | 2009295577 | | 12/2009 |
| JP | 2010103687 | | 5/2010 |
| JP | 2011018571 | | 8/2011 |
| JP | 2011018572 | | 8/2011 |
| TW | 200524186 | | 7/2005 |
| TW | 200524186 | A | 7/2005 |
| TW | 200914759 | A | 4/2009 |
| TW | 201018826 | | 5/2010 |
| TW | 201018826 | A | 5/2010 |
| WO | WO 03102467 | | 12/2003 |
| WO | WO 2006105346 | | 3/2006 |
| WO | WO 2007099860 | | 9/2007 |
| WO | WO 2009030233 | | 3/2009 |
| WO | WO 2009140761 | A1 | 11/2009 |
| WO | WO 2009157999 | | 12/2009 |
| WO | WO 2009157999 | A | 12/2009 |
| WO | WO 2009157999 | A1 | 12/2009 |
| WO | WO 2010024583 | | 3/2010 |
| WO | WO 2010024583 | A2 | 3/2010 |
| WO | WO 2010042216 | | 4/2010 |
| WO | WO 2010042216 | A2 | 4/2010 |
| WO | WO 2011074424 | A1 | 6/2011 |
| WO | WO 2011096098 | A1 | 8/2011 |
| WO | WO 2011098191 | | 8/2011 |
| WO | WO 2011118991 | A2 | 9/2011 |
| WO | WO 2011140353 | A2 | 11/2011 |
| WO | WO 03102467 | | 12/2013 |

OTHER PUBLICATIONS

Office Action from U.S. Appl. No. 14/716,480; dated Mar. 3, 2016.
Office Action from U.S. Appl. No. 13/368,217; dated Mar. 4, 2016.
Office Action from U.S. Appl. No. 13/189,535; dated Mar. 18, 2016.
Office Action from U.S. Appl. No. 14/020,757; dated Apr. 7, 2016.
Office Action from U.S. Appl. No. 29/466,391; dated May 10, 2016.
Second Office Action for Application No. 2011800588770; dated Mar. 29, 2016.

(56) References Cited

OTHER PUBLICATIONS

Office Action from U.S. Appl. No. 13/429,080, dated Sep. 1, 2015.
Office Action from U.S. Appl. No. 14/716,480, dated Sep. 24, 2015.
Office Action from U.S. Appl. No. 14/170,627, dated Oct. 5, 2015.
Office Action from U.S. Appl. No. 13/368,217, dated Oct. 8, 2015.
Office Action from U.S. Appl. No. 13/464,745 dated Oct. 8, 2015.
Office Action from U.S. Appl. No. 29/466,391 dated Oct. 14, 2015.
Office Action from U.S. Appl. No. 12/961,385, dated Nov. 27, 2015.
Office Action from U.S. Appl. No. 13/828,348, dated Nov. 4, 2015.
Office Action from U.S. Appl. No. 14/020,757, dated Nov. 24, 2014.
First Office Action from Chinese Patent Appl. No. 2011800588770, dated Sep. 25, 2015.
Matsushita Electric Works, Ltd., Annual Report, 2007: Jun. 30, 2007. Matsushita Electric Works/Panasonic; 2 pgs.
Controlling LED Lighting Systems: Introducing the LED driver 2004: Craig DiLouis, LED's Magazine, 22 pages.
Luminaires, A Pacific Energy Center Factsheet 1997; 7 pgs.
Gary Steffy, "Architectural Lighting Design", Third Edition, Published by John Wiley & Sons, Inc.
Catalog Page for MFORCE, Matsushita Electric Works/Panasonic.
Sybil P. Parker, "Concise Encyclopedia of Science & Technology", Fourth Edition, McGraw-Hill.
LEDs Magazine, Issue 18 Jan./Feb. 2008.
Lighting Answers, LED Lighting Systems, vol. 2, Issue 3, May 2003.
Matsushita MFOURCE specification Sheet NNN20605, Matsushita Electric Works/Panasonic.
Matsushita MFOURCE specification Sheet NNN20608, Matsushita Electric Works/Panasonic.
Seagull Lighting Brochure, Dec, 21, 2009, Seagull Lighting/Generation Brands.
Silescent 100i LV Light Product Specification Sheet, Seagull Lighting/Generations Brand, 2 pgs.
Lighting Design & Installation: Techniques & Projects for Lighting Your Home and Landscape.
2009 NGL Showcase, Dec. 3-4, 2009: IES/ILAD/US Dept. of Energy.
"PIER Lighting Research Program Project 2.3 Low-Profile LED Luminaries", by Narendran, et al., Apr. 2007, Lighting Research Center, California Energy Commission, pp. 1-70.
Philips eW Downlight Powercore Retailer Guide, © 2009; Philips Solid-State Lighting Solutions, Inc., pp. 1-16.
Specification sheets for Cree LR6, 2012: 2 pages.
Cree LED Lighting Catalog 2013: 148 pgs.
Installation Instructions for Cree LR6, 2013; 2 pgs.
Sea Gull Lighting Installation Instructions www.seagullighting.com/pics/pdf/InstructionsSheets/HC-387.pdf.
Cree LR24 Architectural LED troffer product information, 2 pages, available at www.cree.com/lighting.
Office Action from Japanese Design Patent Application No. 2011-18570.
Reason for Rejection from Japanese Design Patent Application No. 2011-18571.
Reason for Rejection from Japanese Design Patent Application No. 2011-18572.
Preliminary Report and Written Opinion from PCT appl. No. PCT/US2012/047084, dated Feb. 6, 2014.
International Search Report and Written Opinion for PCT Application No. PCT/US2011/062396, dated Jul. 13, 2012.
U.S. Appl. No. 12/873,303, filed Aug. 31, 2010, Edmond, et al.
U.S. Appl. No. 12/961,385, filed Dec. 6, 2010, Pickard, et al.
Cree's XLamp XP-E LED's, data sheet, pp. 1-17.
Cree's XLamp XP-G LED's, data sheet, pp. 1-12.
U.S. Appl. No. 12/418,796, filed Apr. 6, 2009, Pickard, et al.
U.S. Appl. No. 13/429,080, filed Mar. 23, 2012, Edmond, et al.
U.S. Appl. No. 13/028,946, filed Feb. 16, 2011, Le, et al.
U.S. Appl. No. 13/306,589, filed Nov. 29, 2011, Tarsa, et al.
International Search Report and Written Opinion for Patent Application No. PCT/US2011/001517, dated: Feb. 27, 2012.
U.S. Appl. No. 13/649,052, filed Oct. 10, 2012, Lowes, et al.
U.S. Appl. No. 13/649,067, filed Oct. 10, 2012, Lowes, et al.
U.S. Appl. No. 13/207,204, filed Aug. 10, 2011, Athalye, et al.
U.S. Appl. No. 13/365,844, filed Feb. 3, 2012, Pickard, et al.
U.S. Appl. No. 13/662,618, filed Oct. 29, 2012, Athalye, et al.
U.S. Appl. No. 13/462,388, filed May 2, 2012.
U.S. Appl. No. 13/842,150, filed Mar. 15, 2013, Dixon, et al.
U.S. Appl. No. 13/770,389, filed Feb. 19, 2013, Lowes, et al.
U.S. Appl. No. 13/782,820, filed Mar. 1, 2013, Dixon, et al.
XLamp®C family from Cree®, Inc., Product Family Data Sheet, 15 pages.
XLamp®M family from Cree®, Inc., Product Family Data Sheet, 14 pages.
XLamp®X family from Cree®, Inc., Product Family Data Sheet, 17 pages.
Energy Star® Program Requirements for Solid State Lighting Luminaires, Eligibility Criteria—Version 1.1, final: Dec. 19, 2008.
Assist Recommends . . . LED Life for General Lighting: Definition of Life, vol. 1, Issue 1, Feb. 2005.
"IES Approved Method for Measuring Lumen Maintenance of LED light Sources", Sep. 22, 2008, ISBN No. 978-0-87995-227-3, (LM-80).
International Search Report and Written Opinion from PCT Application No. PCT/US2013/021053, dated Apr. 17, 2013.
Search Report and Written Opinion from PCT Patent Appl. No. PCT/US2012/047084, dated Feb. 27, 2013.
Search Report and Written Opinion from PCT Patent Appl. No. PCT/US2012/071800, dated Mar. 25, 2013.
U.S. Appl. No. 12/074,762, filed Mar. 2008, Jacobson, et al.
U.S. Appl. No. 13/442,311, filed Apr. 2012, Lu, et al.
U.S. Appl. No. 13/763,270, filed Feb. 2010, Heeter, et al.
Citadel(tm) SLP Lighting (http://www.slplighting.com/enclosures.html).
Final Rejection issued in Korean Design Appl. No. 30-2011-0038114, dated Jun. 14, 2013.
Final Rejection issued in Korean Design Appl. No. 30-2011-0038115, dated Jun. 14, 2013.
Final Rejection issued in Korean Design Appl. No. 30-2011-0038116, dated Jun. 17, 2013.
International Search Report and Written Opinion from PCT Patent Appl. No. PCT/US2013/035668, dated Jul. 12, 2013.
Notice to Submit a Response from Korean Patent Application No. 30-2011-0038115, dated Dec. 12, 2012.
Notice to Submit a Response from Korean Patent Application No. 30-2011-0038116, dated Dec. 12, 2012.
International Search Report and Written Opinion from Appl. No. PCT/CN2013/072772, dated Dec. 19, 2013.
International Search Report and Written Opinion from PCT/US2013/049225, dated Oct. 24, 2013.
Office Action from U.S. Appl. No. 29/387,171, dated May 2, 2012.
Response to OA from U.S. Appl. No 29/387,171, filed Aug. 2, 2012.
Office Action from U.S. Appl. No. 12/961,385, dated Apr. 26, 2013.
Response to OA from U.S. Appl. No. 12/961,385, filed Jul. 24, 2013.
Office Action from U.S. Appl. No. 13/464,745, dated Jul. 16, 2013.
Office Action from U.S. Appl. No. 29/368,970, dated Jun. 19, 2012.
Office Action from U.S. Appl. No. 29/368,970, dated Aug. 24, 2012.
Response to OA from U.S. Appl. No. 29/368,970, filed Nov. 26, 2012.
U.S. Appl. No. 14/145,559, filed Dec. 31, 2013, Lui, et al.
U.S. Appl. No. 12/463,709, filed May 11, 2009, Donofrio, et al.
U.S. Appl. No. 11/656,759, filed Jan. 22, 2007, Chitnis, et al.
U.S. Appl. No. 11/899,790, filed Sep. 7, 2007, Chitnis, et al.
U.S. Appl. No. 12/566,195, filed Sep. 24, 2009, Van de Ven, et al.
U.S. Appl. No. 12/704,730, filed Feb. 12, 2010, Van de Ven, et al.
U.S. Appl. No. 14/145,355, filed Dec. 31, 2013, Van de Ven, e al.
U.S. Appl. No. 13/828,348, filed Mar. 14, 2013, Edmond, et al.
U.S. Appl. No. 13/345,215, filed Jan. 6, 2012, Lu, et al.
White971 film Technical Data Sheet from WhiteOptics, LLC of New Castel.
Office Action from U.S. Appl. No. 12/961,385, dated Nov. 6, 2013.
"Cree XLamp® XR Family & 4550 LED Reliability", Sep. 2008, www.cree.com/xlamp, 6 pages.

(56) References Cited

OTHER PUBLICATIONS

Office Action from U.S. Appl. No. 13/429,080, dated Apr. 18, 2014.
Office Action from U.S. Appl. No. 12/961,385, dated Mar. 11, 2014.
Reasons for Rejection from Japanese Patent Appl. No. 2013-543207, dated May 20, 2014.
First Office Action from Chinese Patent Appl No. 2011800529984, dated May 4, 2014.
Office Action from U.S. Appl. No. 13/544,662, dated May 5, 2014.
Office Action from U.S. Appl. No. 13/844,431, dated May 15, 2014.
Office Action from U.S. Appl. No. 13/341,741, dated Jun. 6, 2014.
International Preliminary Report on Patentabiliby from PCT/US2012/071800 dated Jul. 10, 2014.
Office Action from U.S. Appl. No. 13/453,924, dated Jun. 25, 2014.
Office Action from U.S. Appl. No. 13/443,630, dated Jul. 1, 2014.
Office Action from U.S. Appl. No. 13/464,745, dated Jul. 16, 2014.
International Preliminary Report on Patentability and Written Opinion from PCT/US2013/021053, dated Aug. 21, 2014.
Communication from European Patent Appl. No. 13701525.1-1757, dated Sep. 26, 2014.
Decision of Rejection from Japanese Appl. No. 2013-543207, dated Nov. 25, 2014.
Office Action from Mexican Appl. No. 100881, dated Nov. 28, 2014.
Grant Notice from European Appl. No. 13701525.1-1757, dated Nov. 24, 2014.
Preliminary Report on Patentability from PCT/US2013/035668, dated Oct. 14, 2014.
Office Action from U.S. Appl. No. 13/189,535, dated Jun. 20, 2014.
Office Action from U.S. Appl. No. 13/442,746, dated Sep. 15, 2014.
Office Action from U.S. Appl. No. 13/429,080, dated Sep. 16, 2014.
Office Action from U.S. Appl. No. 13/844,431, dated Oct. 10, 2014.
Office Action from U.S. Appl. No. 13/443,630, dated Oct. 10, 2014.
Office Action from U.S. Appl. No. 13/368,217, dated Oct. 22, 2014.
Office Action from U.S. Appl. No. 12/961,385, dated Nov. 6, 2014.
Office Action from U.S. Appl. No. 13/453,924, dated Nov. 7, 2014.
Office Action from U.S. Appl. No. 13/828,348, dated Nov. 20, 2014.
Office Action from U.S. Appl. No. 12/873,303, dated Nov. 28, 2014.
Office Action from U.S. Appl. No. 13/464,745, dated Dec. 10, 2014.
Office Action from U.S. Appl. No. 13/341,741, dated Dec. 24, 2014.
Office Action from U.S. Appl. No. 13/189,535, dated Jan. 13, 2015.
Second Office Action and Search Report from Chinese Appl. No. 2011800529984, dated Dec. 26, 2014.
Grant Notice from European Appl. No. 13701525.1, dated Nov. 19, 2014.
International Report and Written Opinion from PCT/US2013/049225, dated Jan. 22, 2015.
Office Action from U.S. Appl. No. 13/787,727, dated Jan. 29, 2015.
Office Action from U.S. Appl. No. 13/429,080, dated Feb. 18, 2015.
Office Action from U.S. Appl. No. 13/453,924, dated Mar. 10, 2015.
First Official Action from European Patent Appl. No. 12 743 003.1-1757, dated Jan, 16, 2015.
Office Action from U.S. Appl. No. 12/873,303, dated Jun. 22, 2015.
Response to OA from U.S. Appl. No. 12/873,303, filed Aug. 21, 2015.
Office Action from U.S. Appl. No. 13/341,741, dated Jun. 22, 2015.
Office Action from U.S. Appl. No. 13/443,630, dated Jun. 23, 2015.
Response to OA from U.S. Appl. No. 13/443,630, filed Aug. 21, 2015.
Office Action from U.S. Appl. No. 13/189,535, dated Jul. 14, 2015.
Office Action from U.S. Appl. No. 13/453,924, dated Jul. 21, 2015.
Office Action from U.S. Appl. No. 13/442,746, dated Jul. 27, 2015.
Office Action from U.S. Appl. No. 14/020,757, dated Aug. 3, 2015.
Notice of Completion of Pretrial Re-examination from Japanese Patent appl. No. 2013-543207, dated Jun. 30, 2015.
Pretrial Report from Japanese Appl. No. 2013-543207, dated Jun. 19, 2015.
Decision of Rejection from Chinese Patent Appl. No. 201180052998.4, dated Jul. 16, 2015.
Office Action for U.S. Appl. No. 13/828,348; dated Jun. 2, 2016.
Notice of Reason for Rejection for Japanese Appl. No. 2013-543207; dated May 24, 2016.
Examination Report from Taiwanese Patent Appl. No. 100131021, dated Jan. 5, 2016.
Examination from European Patent Appl. No. 12743403.1-1757, dated Jan. 8, 2016.
Notice of Reasons for Rejection from Japanese Patent Appl. No. 2013-543207, dated Feb. 2, 2016.
Examination from European Patent Appl. No. 13 701 525.1-1757, dated Feb. 3, 2016.
Office Action from U.S. Appl. No. 13/189,535; dated Jan. 6, 2016.
Office Action from U.S. Appl. No. 13/341,741; dated Jan. 8, 2016.
Office Action from U.S. Appl. No. 13/873,303; dated Feb. 2, 2016.
Office Action for U.S. Appl. No. 14/716,480; dated Feb. 8, 2017.
Foreign Office Action for Japanese Application No. 2013-543207; dated Feb. 14, 2017.
Office Action for U.S. Appl. No. 14/225,327; dated Mar. 14, 2017.
European Notice of Allowance for Application No. 12743003.1; dated Mar. 17, 2017.
Office Action for U.S. Appl. No. 13/189,535; dated Mar. 23, 2017.
Office Action for U.S. Appl. No. 13/464,745; dated Mar. 23, 2017.
Foreign Office Action for Chinese Application No. 2011800529984; dated Apr. 5, 2017.
Office Action for U.S. Appl. No. 14/721,806; dated Apr. 21, 2017.
Office Action for U.S. Appl. No. 13/443,630; dated May 18, 2017.
Office Action for Chinese Patent Application No. 2011800588770; dated Sep. 26, 2016.
Notification of Reexamination for Chinese Application No. 2011800529984; dated Oct. 10, 2016.
Office Action for U.S. Appl. No. 13/828,348; dated Oct. 17, 2016.
Office Action for European Application No. 11754767.9; dated Oct. 31, 2016.
Office Action for U.S. Appl. No. 12/873,303; dated Nov. 25, 2016.
Notice of Allowance for Taiwan Application No. 100131021; dated Nov. 28, 2016.
Office Action for U.S. Appl. No. 13/368,217; dated Jan. 3, 2017.
Office Action for U.S. Appl. No. 14/020,757; dated Jul. 19, 2016.
Examination Report from Taiwan Application No. 100131021; dated Jul. 21, 2016.
Office Action for U.S. Appl. No. 14/716,480; dated Aug. 26, 2016.
European Summons for Oral Proceedings for Application No. 12743003.1; dated Sep. 2, 2016.
Office Action for U.S. Appl. No. 13/464,745; dated Sep. 7, 2016.
Office Action for U.S. Appl. No. 14/225,327; dated Oct. 2, 2017.
Office Action for U.S. Appl. No. 13/189,535; dated Oct. 30, 2017.
Office Action for U.S. Appl. No. 14/721,806; dated Nov. 1, 2017.
Office Action for U.S. Appl. No. 14/170,627; dated Nov. 29, 2017.
Office Action for U.S. Appl. No. 13/464,745; dated Dec. 11, 2017.
Office Action for U.S. Appl. No. 14/716,480; dated Jan. 17, 2018.

* cited by examiner

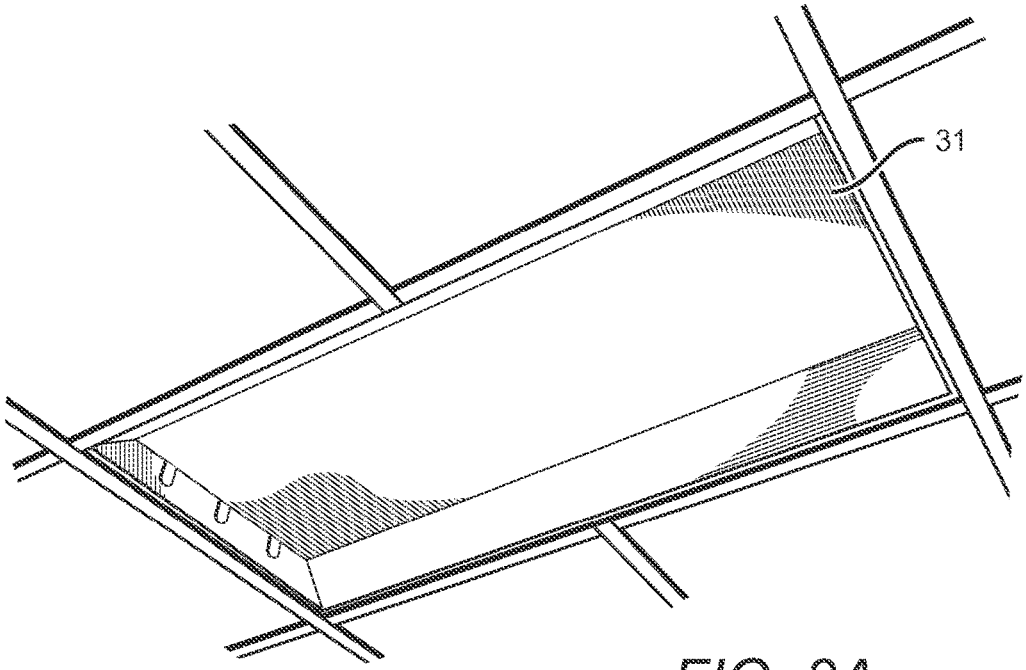
FIG. 3A
FIG. 3B
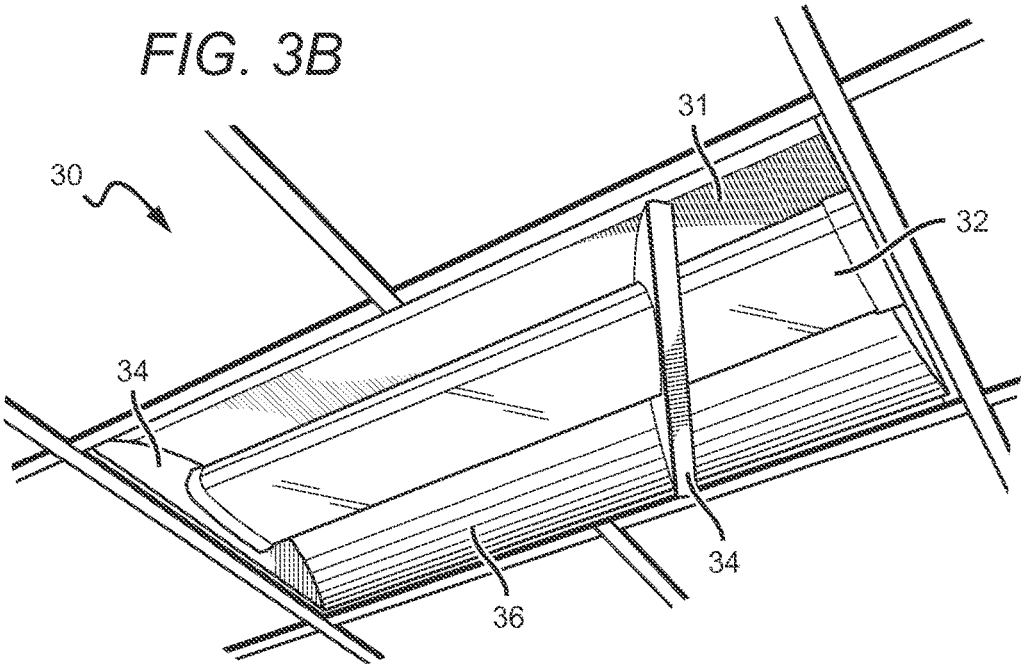

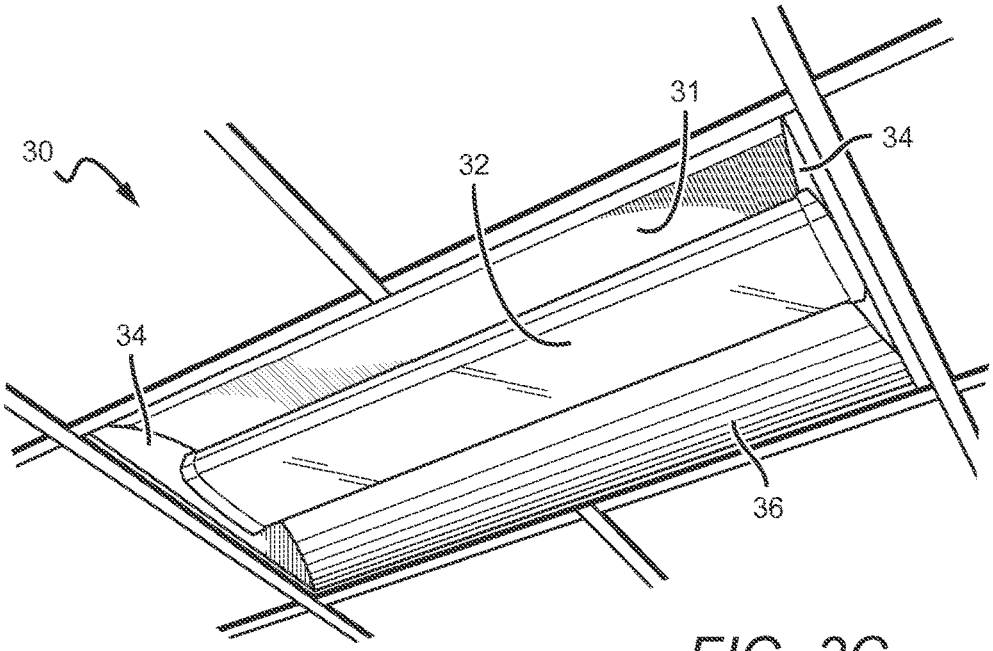
FIG. 3C
FIG. 3D
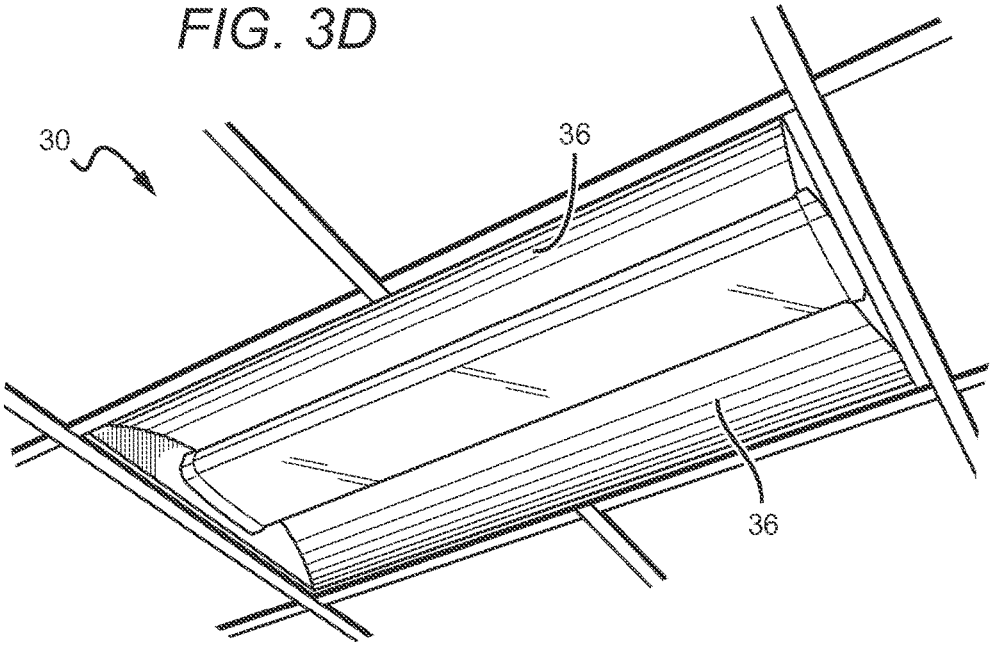

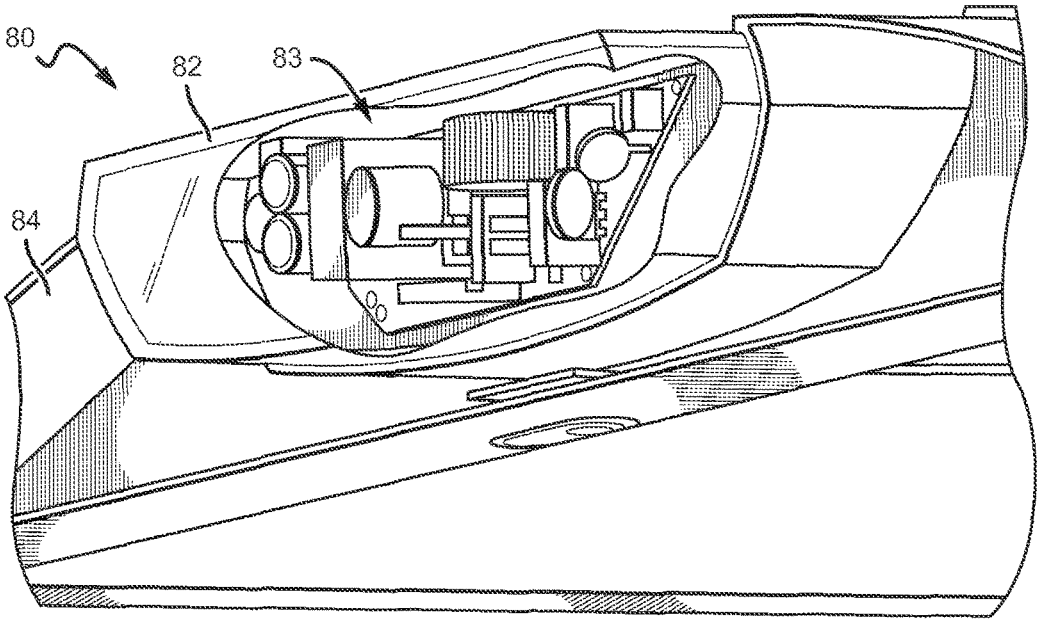
FIG. 8
FIG. 9
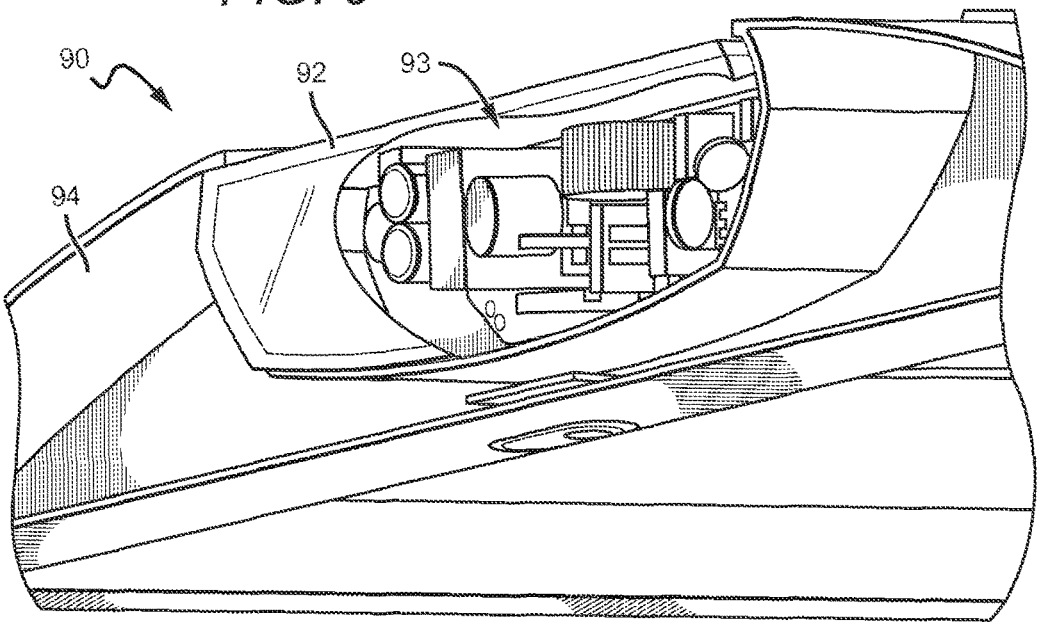

ADJUSTABLE RETROFIT LED TROFFER

BACKGROUND OF THE INVENTION

Field of the Invention

The invention relates to lighting luminaires and, more particularly, to indirect, direct, and direct/indirect lighting troffers that are well-suited for use with solid state lighting sources, such as light emitting diodes (LEDs).

Description of the Related Art

Troffer-style fixtures are ubiquitous in commercial office and industrial spaces throughout the world. In many instances these troffers house elongated fluorescent light bulbs that span the length of the troffer. Troffers may be mounted to or suspended from ceilings. Often the troffer may be recessed into the ceiling, with the back side of the troffer protruding into the plenum area above the ceiling. Typically, elements of the troffer on the back side dissipate heat generated by the light source into the plenum where air can be circulated to facilitate the cooling mechanism. U.S. Pat. No. 5,823,663 to Bell, et al. and U.S. Pat. No. 6,210,025 to Schmidt, et al. are examples of typical troffer-style fixtures. Another example of a troffer-style fixture is U.S. patent application Ser. No. 12/961,385 to Pickard, which is commonly assigned with the present application and incorporated by reference herein.

More recently, with the advent of efficient solid state lighting sources, these troffers have been used with LEDs, for example. LEDs are solid state devices that convert electric energy to light and generally comprise one or more active regions of semiconductor material interposed between oppositely doped semiconductor layers. When a bias is applied across the doped layers, holes and electrons are injected into the active region where they recombine to generate light. Light is produced in the active region and emitted from surfaces of the LED.

LEDs have certain characteristics that make them desirable for many lighting applications that were previously the realm of incandescent or fluorescent lights. Incandescent lights are very energy-inefficient light sources with approximately ninety percent of the electricity they consume being released as heat rather than light. Fluorescent light bulbs are more energy efficient than incandescent light bulbs by a factor of about 10, but are still relatively inefficient. LEDs by contrast, can emit the same luminous flux as incandescent and fluorescent lights using a fraction of the energy.

In addition, LEDs can have a significantly longer operational lifetime. Incandescent light bulbs have relatively short lifetimes, with some having a lifetime in the range of about 750-1000 hours. Fluorescent bulbs can also have lifetimes longer than incandescent bulbs such as in the range of approximately 10,000-20,000 hours, but provide less desirable color reproduction. In comparison, LEDs can have lifetimes between 50,000 and 70,000 hours. The increased efficiency and extended lifetime of LEDs is attractive to many lighting suppliers and has resulted in LED lights being used in place of conventional lighting in many different applications. It is predicted that further improvements will result in their general acceptance in more and more lighting applications. An increase in the adoption of LEDs in place of incandescent or fluorescent lighting would result in increased lighting efficiency and significant energy savings.

Other LED components or lamps have been developed that comprise an array of multiple LED packages mounted to a (PCB), substrate, or submount. The array of LED packages can comprise groups of LED packages emitting different colors, and specular reflector systems to reflect light emitted by the LED chips. Some of these LED components are arranged to produce a white light combination of the light emitted by the different LED chips.

In order to generate a desired output color, it is sometimes necessary to mix colors of light which are more easily produced using common semiconductor systems. Of particular interest is the generation of white light for use in everyday lighting applications. Conventional LEDs cannot generate white light from their active layers; it must be produced from a combination of other colors. For example, blue emitting LEDs have been used to generate white light by surrounding the blue LED with a yellow phosphor, polymer or dye, with a typical phosphor being cerium-doped yttrium aluminum garnet (Ce:YAG). The surrounding phosphor material "downconverts" some of the blue light, changing it to yellow light. Some of the blue light passes through the phosphor without being changed, while a substantial portion of the light is downconverted to yellow. The LED emits both blue and yellow light, which combine to yield white light.

In another known approach, light from a violet or ultraviolet emitting LED has been converted to white light by surrounding the LED with multicolor phosphors or dyes. Indeed, many other color combinations have been used to generate white light.

Because of the physical arrangement of the various source elements, multicolor sources often cast shadows with color separation and provide an output with poor color uniformity. For example, a source featuring blue and yellow sources may appear to have a blue tint when viewed head on and a yellow tint when viewed from the side. Thus, one challenge associated with multicolor light sources is good spatial color mixing over the entire range of viewing angles. One known approach to the problem of color mixing is to use a diffuser to scatter light from the various sources.

Another known method to improve color mixing is to reflect or bounce the light off of several surfaces before it is emitted from the lamp. This has the effect of disassociating the emitted light from its initial emission angle. Uniformity typically improves with an increasing number of bounces, but each bounce has an associated optical loss. Some applications use intermediate diffusion mechanisms (e.g., formed diffusers and textured lenses) to mix the various colors of light. Many of these devices are lossy and, thus, improve the color uniformity at the expense of the optical efficiency of the device.

Many current luminaire designs utilize forward-facing LED components with a specular reflector disposed behind the LEDs. One design challenge associated with multi-source luminaires is blending the light from LED sources within the luminaire so that the individual sources are not visible to an observer. Heavily diffusive elements are also used to mix the color spectra from the various sources to achieve a uniform output color profile. To blend the sources and aid in color mixing, heavily diffusive exit windows have been used. However, transmission through such heavily diffusive materials causes significant optical loss.

Some recent designs have incorporated an indirect lighting scheme in which the LEDs or other sources are aimed in a direction other than the intended emission direction. This may be done to encourage the light to interact with internal elements, such as diffusers, for example. Examples of indirect fixtures can be found in U.S. Pat. No. 7,722,220 to Van de Ven and U.S. patent application Ser. No. 12/873,303 to Edmond et al., both of which are commonly assigned with the present application and incorporated by reference herein.

Modern lighting applications often demand high power LEDs for increased brightness. High power LEDs can draw large currents, generating significant amounts of heat that must be managed. Many systems utilize heat sinks which must be in good thermal contact with the heat-generating light sources. Troffer-style fixtures generally dissipate heat from the back side of the fixture that extends into the plenum. This can present challenges as plenum space decreases in modern structures. Furthermore, the temperature in the plenum area is often several degrees warmer than the room environment below the ceiling, making it more difficult for the heat to escape into the plenum ambient.

In some cases, it may be desirable to replace or retrofit existing troffer-style fixtures, which have fluorescent light bulbs with newer LED emitters. As such, it can be helpful to design retrofit systems for these fixtures.

SUMMARY OF THE INVENTION

The present disclosure describes embodiments of light fixtures. For example, one embodiment of a direct emission light fixture according to the present disclosure comprises a plurality of light sources and a lens over said plurality of light sources. The fixture also comprises first and second end reflectors, wherein one of the end reflectors is movable along the lens. The fixture also includes at least one movable back reflector between said first and second end reflectors.

Another embodiment of a light fixture comprises first and second end reflectors, wherein one of the end reflectors is configured to define an interior compartment. The fixture also comprises at least one back reflector between the end reflectors and a plurality of light sources oriented to output light in the same direction as the fixture. Additionally, the fixture includes a lens over the light sources, wherein one of the end reflectors is movable along the lens.

Yet another embodiment of a light fixture according to the present disclosure comprises a first and second component. The first component comprises first and second end reflectors and a first back reflector between the end reflectors. The first component also comprises a plurality of light sources, such that the light sources are oriented to output light in the same direction as the fixture and a lens over the light sources, wherein at least one of said end reflectors is movable along the lens. The second component comprises a second back reflector and the second component is removably attached to the first component.

A better understanding of the features and advantages of the present embodiments will be obtained by reference to the following detailed description of the invention and accompanying drawings, which set forth illustrative embodiments in which the principles of the invention are utilized.

BRIEF DESCRIPTION OF THE DRAWINGS

FIGS. 3A-3D are perspective views of a fixture according to the present disclosure in several stages of installation.

FIG. 8 is a side view of an end compartment according to one embodiment of the present disclosure.

FIG. 9 is another side view of an end compartment with the end reflector in a different position according to one embodiment of the present disclosure.

DETAILED DESCRIPTION OF THE INVENTION

Figure 1:
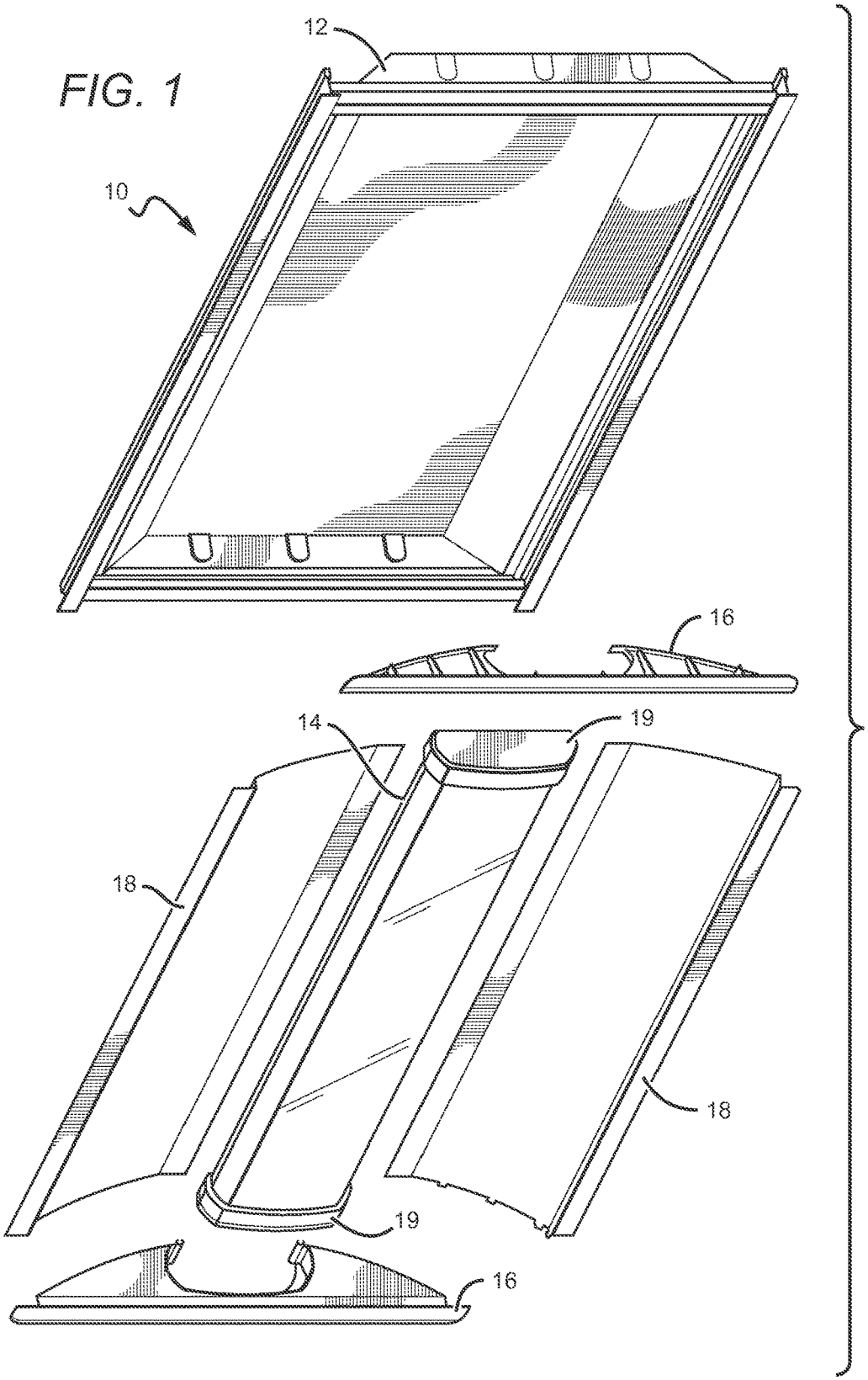
FIG. 1 is an exploded perspective view of a lighting fixture according to an embodiment of the present disclosure.

Embodiments of the present invention provide a direct troffer-style fixture that is particularly well-suited for use with solid state light sources, such as LEDs and retrofit structures for use in pan-style fixtures. The fixture comprises a retrofit troffer assembly that is removably attached within a T grid or pan structure. The pan structure may be an already existing component or may be provided with the retrofit troffer. The retrofit troffer includes a lens structure, which creates an interior space. The interior space created by the lens structure houses light emitters and in some circumstances a light engine and/or additional electronics. First and second end reflectors surround the lens and are disposed at either end of the lens. One or both of these end reflectors may be movable. Optionally, one or more end caps may be incorporated into the end portions of the lens structure to section off the interior space of the lens for housing electronics, such as a light engine. A light board may be removably attached to the base of the lens structure. A back reflector covers most of the interior surfaces of the troffer fixture to direct more light out of the fixture.

It is understood that when an element is referred to as being "on" another element, it can be directly on the other element or intervening elements may also be present. Furthermore, relative terms such as "inner", "outer", "upper", "above", "lower", "beneath", and "below", and similar terms, may be used herein to describe a relationship of one element to another. It is understood that these terms are intended to encompass different orientations of the device in addition to the orientation depicted in the figures.

Although the ordinal terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present invention.

As used herein, the term "source" can be used to indicate a single light emitter or more than one light emitter functioning as a single source. For example, the term may be used to describe a single blue LED, or it may be used to describe a red LED and a green LED in proximity, emitting as a single source. Thus, the term "source" should not be construed as a limitation indicating either a single-element or a multi-element configuration unless clearly stated otherwise.

The term "color" as used herein with reference to light is meant to describe light having a characteristic average wavelength; it is not meant to limit the light to a single wavelength. Thus, light of a particular color (e.g., green, red, blue, yellow, etc.) includes a range of wavelengths that are grouped around a particular average wavelength.

Embodiments of the invention are described herein with reference to cross-sectional view illustrations that are schematic illustrations. As such, the actual size of elements can be different, and variations from the shapes of the illustrations as a result, for example, of manufacturing techniques and/or tolerances are expected. Thus, the elements illustrated in the figures are schematic in nature and their shapes are not intended to illustrate the precise shape of any elements of a device and are not intended to limit the scope of the invention.

FIG. 1 is an exploded perspective view of a lighting fixture 10 according to an embodiment of the present invention. The fixture 10 can fit or be placed within an optional pan structure 12. The lighting fixture 10 includes lens 14, which houses light emitters. On either end of the lens 14 are end reflectors 16, which fit around the lens 14 and help keep the lens in place. Situated between the end reflectors 16 and surrounding the lens 14 are back reflectors 18. Back reflectors 18 may be a singular back reflector, which spans the entire back side of the fixture or may be two separate panels as shown in FIG. 1. The reflectors may be stationary or movable/removable, for ease of installation. FIG. 1 also shows optional end caps 19.

The fixture described in the present disclosure is a means to easily install a retrofit troffer, as well as to adjust the size and shape of the fixture during installation. The fixture can be adjusted in length by means of sliding at least one of the end reflectors along the length of the lens. The width of the fixture can be adjusted by sliding at least one of the reflectors together or away from one another. This allows the installer the means to make adjustments to the size and shape of the retrofit fixture to accommodate the existing pan and fitting the fixture into the existing pan during installation. The sliding and/or rotating reflectors also make it easier when installing and wiring the fixture. Previously, fixtures would be installed as many different components; however, embodiments according to the present disclosure allow for installation as one or two pieces; end reflectors, back reflector, light engine, and lens. In some embodiments, the fixtures may only be adjusted in size during installation, and returned to a fixed length and width once installation is completed. In other embodiments, the adjustments may be made to the final installed fixture as well.

In some embodiments, the back reflector may be multiple pieces and one of them may be installed separately. Thereby the installer only needs to make one trip up the ladder for the installation. When a person installs an existing retrofit troffer they first have to remove the current fluorescent tubes, lens and ballast cover. Next, they start to install the parts for the retrofit fixture. For the current or previous products available, there are at least 4-6 separate components required for the installation. The installer must go up and down the ladder to collect each component or a second person is required to assist with handing up parts. The fixtures according to the present disclosure are self-contained retrofit troffers that come in one to two pieces. The fixture has interlocking end reflectors, such that one end cap is interlocked with the lens and slides and/or rotates along the lens during installation, while the other end cap may be fixed in place. The back reflectors are also designed to slide away, be removed, or nest during installation and wiring and then be deployed by sliding them down along the end caps and lens, or placing a removed back reflector back in place.

Figure 2:
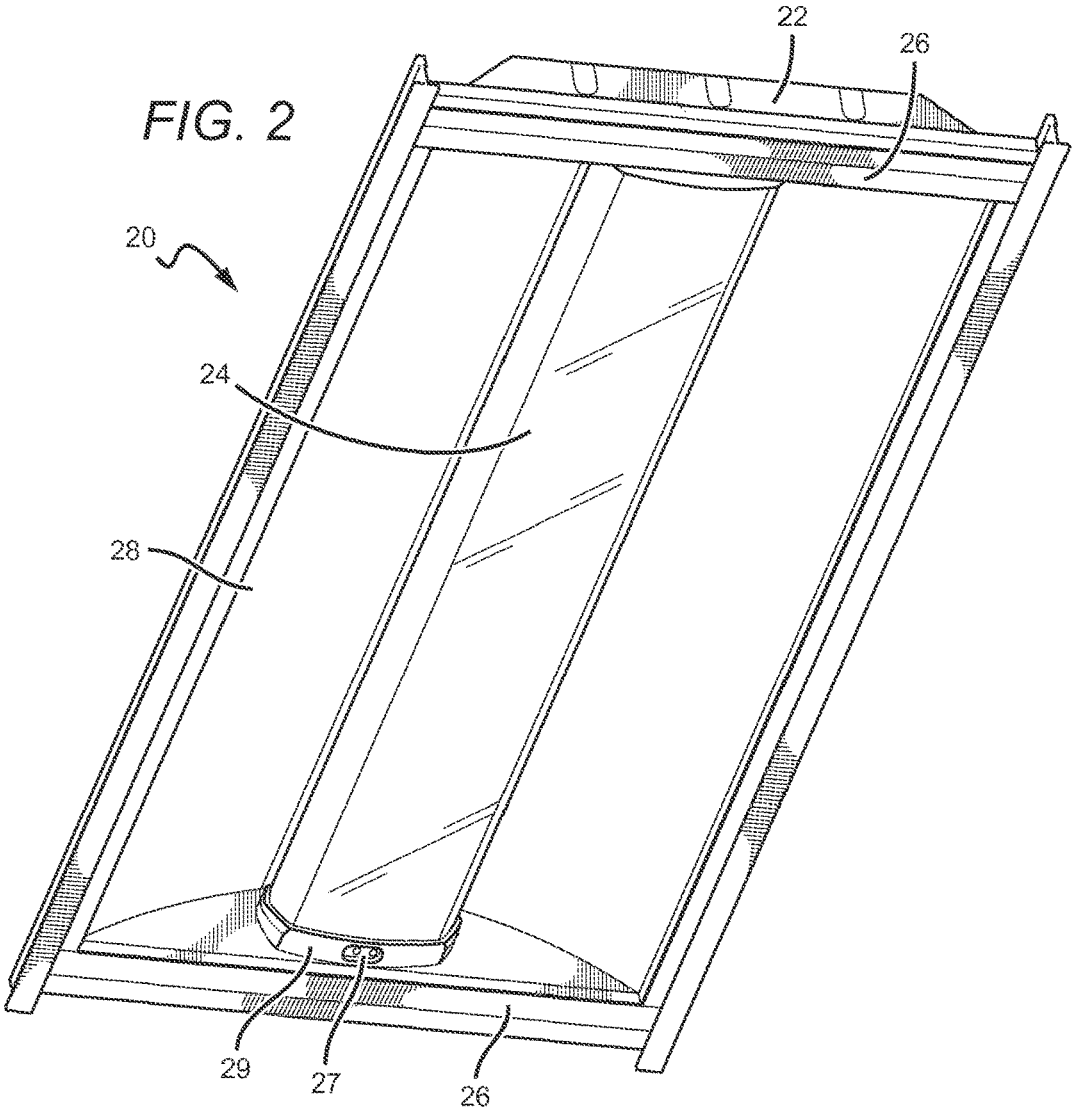
FIG. 2 is a perspective view of a fixture according to an embodiment of the present disclosure.

FIG. 2 is a perspective view of a fixture 20 according to an embodiment of the present disclosure. Fixture 20 is similar to the one shown in FIG. 1, in the assembled or installed configuration. Some embodiments, such as the one shown here include a lens 24 which houses an LED board, a sliding end reflector 26 and a fixed end reflector, a pair of back reflectors, and a driver housed in the lens on the same side as the fixed end reflector. FIG. 2 shows an optional pan 22, which is not very visible as the interior is covered by the remaining components. The length and width of the fixture may be adjusted by moving end reflectors 26 and back reflectors 28, such that they may be slid further from or closer to the center or lens 24 of the fixture. The reflectors may be removably attached to the remainder of the fixture by several methods, such as snap fit, screws, fasteners, alignment holes, or any other method. The fixture 20 may also optionally include end caps 29 and sensing equipment or openings for the same 27.

With reference to FIG. 2, in the embodiment of fixture 20, the back reflector 28 comprises two pieces, that join in the middle to form a single reflective body. In other embodiments, the back reflector can be one monolithic structure. The reflectors are shaped to substantially cover the area of the fixture within the interior space to redirect any light up toward the open end. In some embodiments, the reflectors are faceted or have faceted surfaces. In other embodiments, the reflectors are faceted to create the bended shape; however a back reflector with a smooth bending transition may be used. Many different back reflector shapes are possible.

FIGS. 3A-3D show an exemplary process of installing a troffer fixture according to an embodiment of the present disclosure. FIG. 3A shows a ceiling pan 31, which may have been installed in this manner or been emptied after the removal of a previous fixture. FIG. 3B shows the new fixture 30 during the first step of installation. In FIG. 3B, the first piece of the fixture 30 is placed within the pan 31 or T grid. This first piece includes a back reflector 36, a stationary end reflector 34, lens and light emitters 32, and a sliding and rotating end reflector 34. As seen in the figure, the side of the lens 32 opposite the back reflector 36 does not have a second back reflector in place and a portion of the pan 31 is exposed. This is done intentionally in order to allow for the fixture to be placed within the pan 31, because the pan 31 or T grid have a lip which is narrower than the area the fixture resides, the fixture must be narrower than the lip during the initial installation. Therefore, it is necessary that one of the end reflectors be movable from the edge, and rotatable, in order to reduce the length during installation. It is also necessary that one of the back reflectors be slidable or removable in order to reduce overall width of the fixture during insertion into the pan.

FIG. 3C shows the fixture 30 in the next step of the installation. In this step, the slidable end cap 34 is rotated and moved to the final position at the edge of the fixture. During this step, once the end reflector 34 is in place, an installer may then use the opening on the opposite side of the back reflector 36 to complete fixture wiring. FIG. 3D shows fixture 30 fully installed with the back reflectors 36 fully in place, such that the pan 31 is no longer visible. The reflectors may be disposed at many angles to accommodate different output profiles. The end reflectors and back reflectors should comprise a reflective surface on the side that faces the interior space or lens. When assembled, the end reflectors perform several functions: they retain elements within the compartments (in embodiments with end compartments);

they provide added structural stability to the fixture; they aid in aligning the lens; and they reflect light that impinges on them toward the open end of the fixture. These end compartments may house a variety of items, such as driver circuits, circuit isolation structures, batteries, sensors, or other appropriate electronics.

Figure 4:
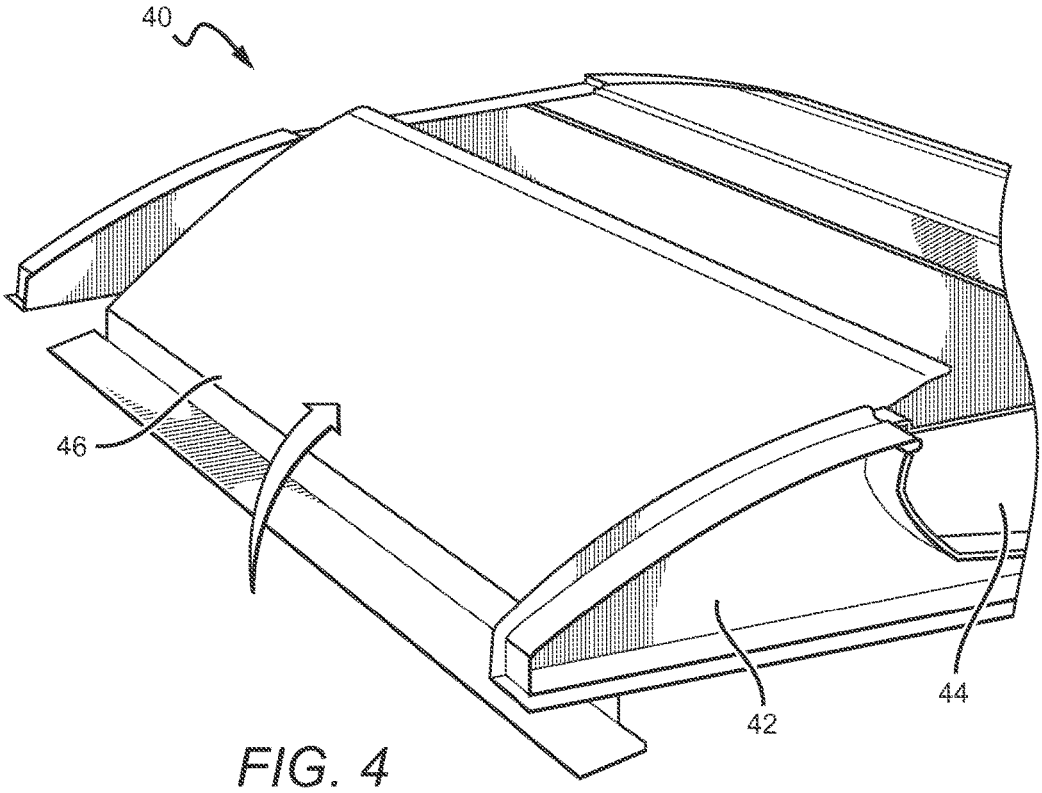
FIG. 4 is a back perspective view of the fixture according to an embodiment of the present disclosure.

FIG. 4 is a perspective view of the back side of an exemplary fixture 40, showing one embodiment of a movable or removable back reflector 46. As shown, the back reflector 46, between end reflectors 42, is partially in place and partially slid over the lens 44. This view shows how a reflector may be slid into place after installation of the remainder of the fixture 40, such as between the installation steps shown in FIGS. 3C and 3D.

Figure 6:
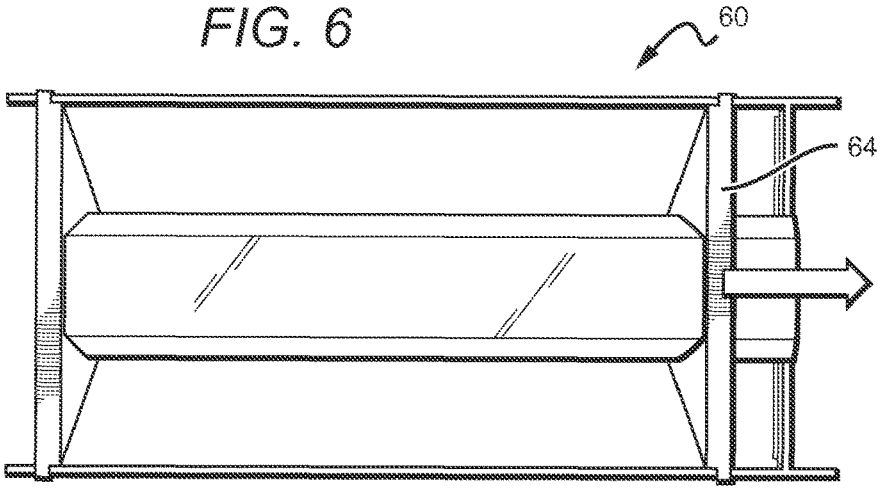
FIGS. 6, 7A, and 7B show detailed views of the first end reflector in different positions during installation that may be used in embodiments of the present disclosure.
Figure 5:
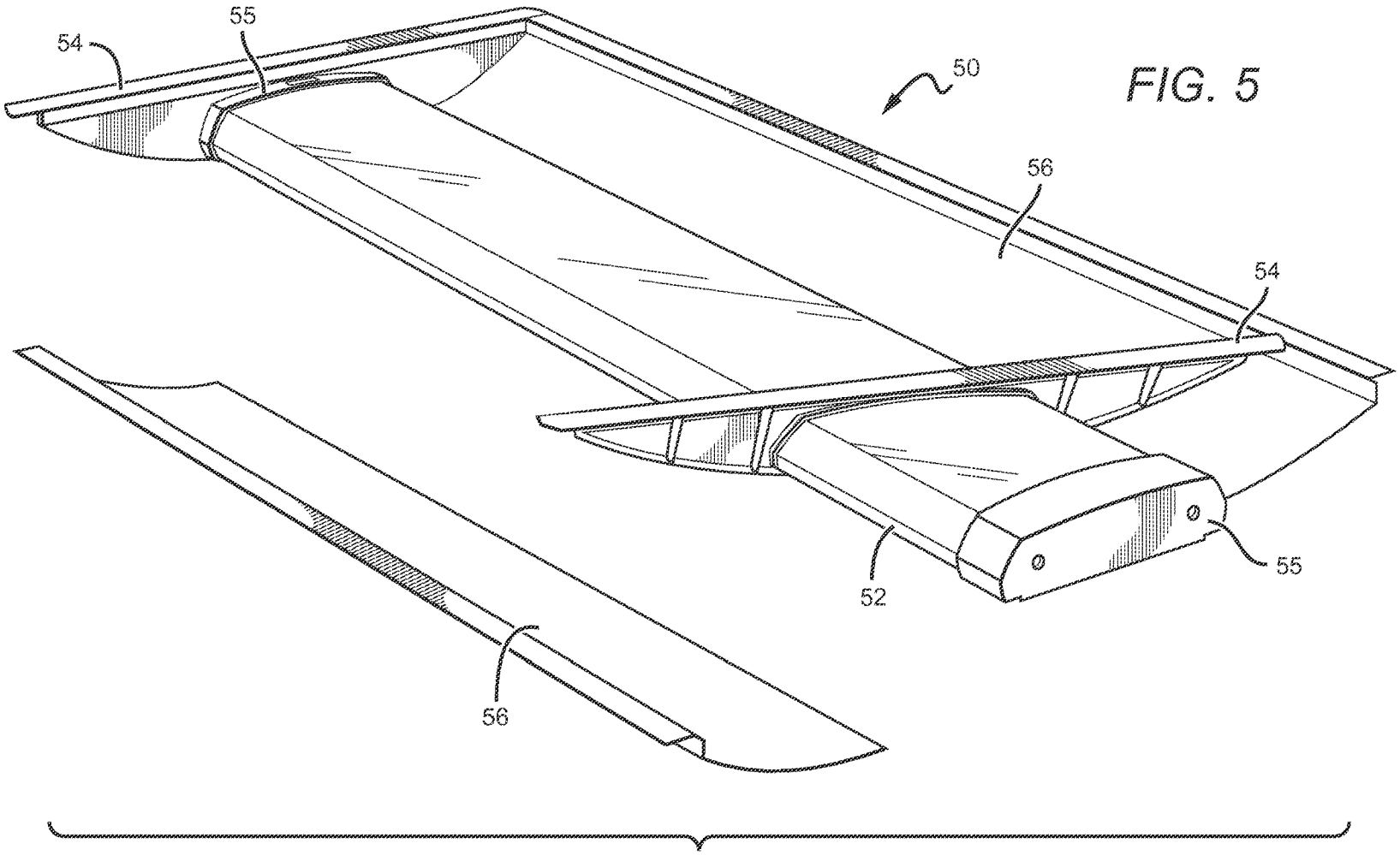
FIG. 5 is a perspective view of a fixture before installation according to one embodiment of the present disclosure.

FIG. 5 is another perspective view of a fixture 50 in a configuration for installation into a T grid or pan. As shown, the fixture 50 includes a center lens 52, end reflectors 54, back reflectors 56, and optional end caps 55. Though one center lens 52 is shown, it is understood this may also be a collection of lenses. Also, though a tubular lens is shown, it is understood that this lens may also be a cover. Additionally, though the lens is shown to be centered, the lens may also be situated on either or both sides of the fixture. The configuration as shown, with one end reflector 54 slid away from the end and rotated and one back reflector temporarily removed, allows for the fixture to be placed in a T grid or pan and fit through the narrowed portion of the same. Although only one end cap is shown to be moved, while the other is stationary, in other embodiments, both may be slidable and rotatable. The end reflectors 54 may be made of a variety of materials, such as plastics or metals. The end reflectors may also be reflective, such that they are made of or include a coating of a metal or a white highly reflective material. The lens 52 may be include optional end caps 55 or in other embodiments there may not be additional outer end caps (as shown in FIG. 6). In place of an end cap 55, a division or end cap area may be present inside the lens 52, to provide mechanical shielding. The area within the end cap or end cap area can be used to house electronics. The electronics may be housed only on the side of the stationary end reflector 54 or on both sides. These areas may also house environmental sensing technologies, which can be used to change operation of the light.

FIG. 5 shows one of the back reflectors 56 removed from the remainder of the fixture. In place of removal, in other embodiments, the back reflector may be slid up and behind the center lens or fixture, in order to accommodate the narrowed portion of the T grid or pan during installation and allow for access behind the fixture to complete wiring during installation. The back reflectors may be made of or coated with a reflective metal, plastic, or white material. One suitable metal material to be used for the reflectors being aluminum (Al). The end and back reflectors may also include diffusing components if desired. The back reflector may be mounted to the remainder of the fixture using tabs, notches, screws, snap or slide in mechanisms, or other fastening methods. Having one of the back reflectors be removable or movable is advantageous as maintenance can be done from the room-side or the ceiling-side without having to remove the fixture from its mount or significantly disassemble any portion of the fixture.

The back and end reflectors may comprise many different materials. For many indoor lighting applications, it is desirable to present a uniform, soft light source without unpleasant glare, color striping, or hot spots. Thus, the back reflectors may comprise a diffuse white reflector, such as a microcellular polyethylene terephthalate (MCPET) material or a DuPont/WhiteOptics material, for example. Other white diffuse reflective materials can also be used. The back reflectors may also be aluminum with a diffuse white coating.

It is understood that many different fixture and reflector assemblies may be used to achieve a particular output light profile. The fixtures shown can be provided in many sizes, including standard troffer fixture sizes, such as 2 feet by 4 feet (2'×4') or 2 feet by 2 feet (2'×2'), for example. However, it is understood that the elements of the shown fixtures may have different dimensions that correspond to the fixture sizes. Furthermore, it is understood that embodiments of the fixture can be customized to fit most any desired fixture dimension.

Figure 7B:
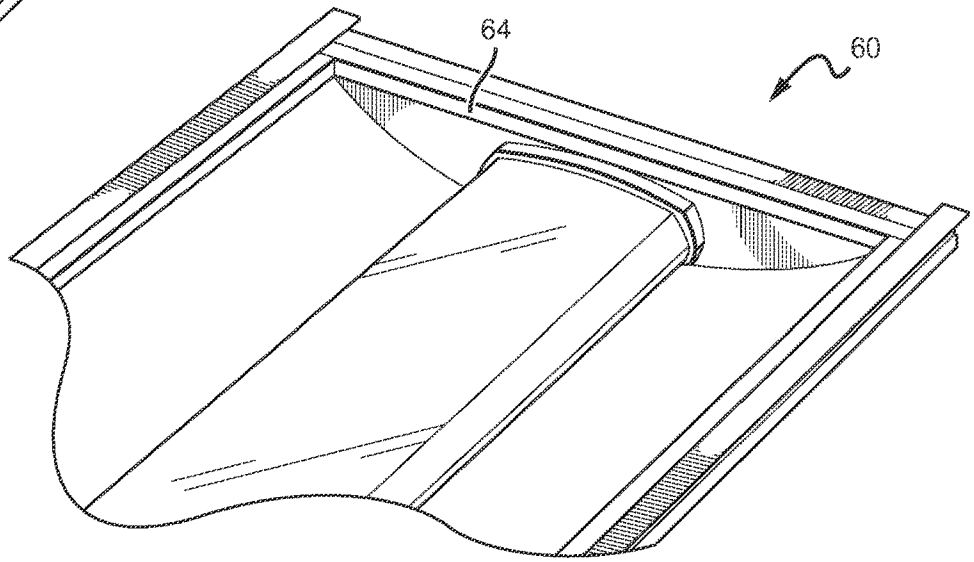
Figure 7A:
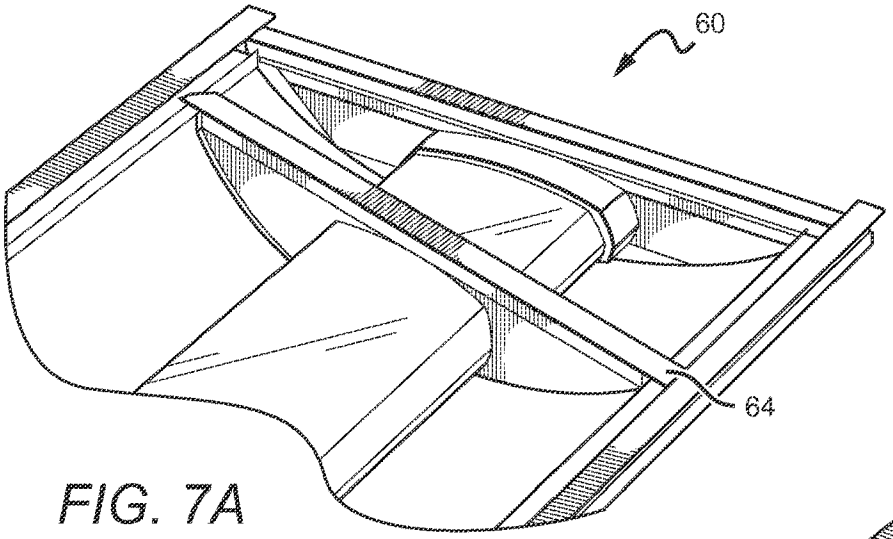

FIGS. 6, 7A, and 7B show how the end reflector 64 of fixture 60 may be moved from the position shown in FIG. 5 to an installed position in FIG. 7B. The end reflector 60 may be moved in the direction shown by the arrow, towards the end of the fixture 60. If the end reflector 60 has been rotated, it may also need to be straightened, as shown in FIGS. 6 and 7A. FIG. 7B shows the end reflector 60 in the final installed position. It should be understood, if it is desired that the end reflector be placed further toward the center, to accommodate a particular application, the end reflector may be placed in other positions.

FIGS. 8 and 9 show side views of the fixture 80, 90, depicting the component compartment 83, 93, at the end of the lens 82, 92. This compartment 83, 93, may be created by an inner divider or end cap, or an outer end cap as shown in FIG. 5. The end compartment 83, 93, is also defined by the end reflector 84, 94, which surrounds the compartment when in the installed position. As shown in FIG. 8, the end reflector 84 is slid away from the end, and in FIG. 9 the end reflector 94 is slid to the end of the lens 92. These compartments provide space to house various components, such as circuits, batteries, wiring, and the like. In this particular embodiment, a driver circuit is housed with a compartment. Electronic components within the compartments may be shielded and isolated from the remainder of the lens. Here, an isolation structure may partially surround the driver circuit for this purpose. The isolation structure may also function as a flame barrier (e.g., Formex™, ceramic, or a UL94 5 VA rated transparent plastic) which is required to cover the high voltage components if they are used.

Various driver circuits may be used to power the light sources. Suitable circuits are compact enough to fit within the compartments, while still providing the power delivery and control capabilities necessary to drive high-voltage LEDs, for example. At the most basic level a driver circuit may comprise an AC to DC converter, a DC to DC converter, or both. In one embodiment, the driver circuit comprises an AC to DC converter and a DC to DC converter, both of which are located inside the compartment. In another embodiment, the AC to DC conversion is done remotely (i.e., outside the fixture), and the DC to DC conversion is done at the control circuit inside the compartment. In yet another embodiment, only AC to DC conversion is done at the control circuit within the compartment.

Figure 10:
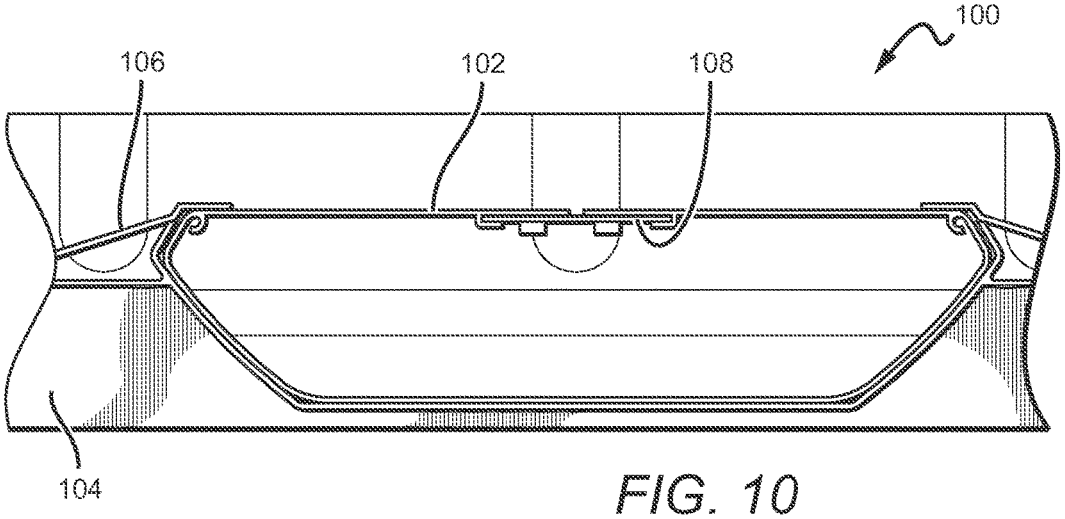
FIG. 10 is a representative cross-sectional side view of a fixture according to one embodiment of the present disclosure.

FIG. 10 shows a cross section of the fixture 100, showing the interlocking end reflector 104, back reflector 106, and lens 102. The lens 102 houses a light board with light emitters 108. The light board may be any appropriate board, such as a PCB or flexible circuit board. Light emitters may include any appropriate light emitters, such as LEDs. The light board and light emitters, or lighting strips can include the electronics and interconnections necessary to power the light emitters or LEDs. In some embodiments the lighting strip comprises a PCB with the LEDs mounted and interconnected thereon. The lighting strip may include clusters of discrete LEDs, with each LED within the cluster spaced a distance from the next LED, and each cluster spaced a distance from the next cluster. If the LEDs within a cluster are spaced at too great a distance from one another, the colors of the individual sources may become visible, causing unwanted color-striping. In some embodiments, an acceptable range of distances for separating consecutive LEDs within a cluster is not more than approximately 8 mm. Some embodiments may use a series of clusters having two blue-shifted-yellow LEDs ("BSY") and a single red LED ("R"). Once properly mixed the resultant output light will have a "warm white" appearance. Other embodiments may use a series of clusters having three BSY LEDs and a single red LED. This scheme will also yield a warm white output when sufficiently mixed. Yet other embodiments may use a series of clusters having two BSY LEDs and two red LEDs. This scheme will also yield a warm white output when sufficiently mixed.

The light board may be permanently attached or, more likely, may be removably attached to the lens by being slid into a holding mechanism or mounted via alignment holes (not shown). The light board aligns with the center portion of the end reflectors and lens. Additionally, the back reflectors may also be slid into place or mounted via alignment holes. The reflectors and the light boards can be mounted with similar mechanisms, such as retention clips. It is understood that nearly any length of light board can be used. In some embodiments, any length can be built by combining light boards together to yield the desired length. The light sources or emitters can be mounted in a linear pattern or in clusters. In some embodiments, the light sources may be mounted to a light strip and then to the light board.

The lens 102 may be a singular piece or may be constructed of multiple assembled pieces. The lens 102 may be made of plastic, such as extruded plastic. In other embodiments, the front portion of the lens 102 may be made of plastic, such that is it clear or diffuse while allowing light to exit the fixture. In some embodiments, the back area of the lens 102 or the surfaces on the side of the lens adjacent to the light emitters and light board 108 may be reflective. For example, this area may be coated with a white reflective material. In other embodiments, this area of the lens may be sheet metal, such that the front section is extruded plastic, which is snapped in place to a metal back portion. The front area of the lens 102 may be uniform or may have different features and diffusion levels. In other embodiments, portions of the lens may be diffusive, whereas other portions may be reflective. In yet other embodiments, a portion of the lens may be more diffuse than the remainder of the lens.

Figure 11:
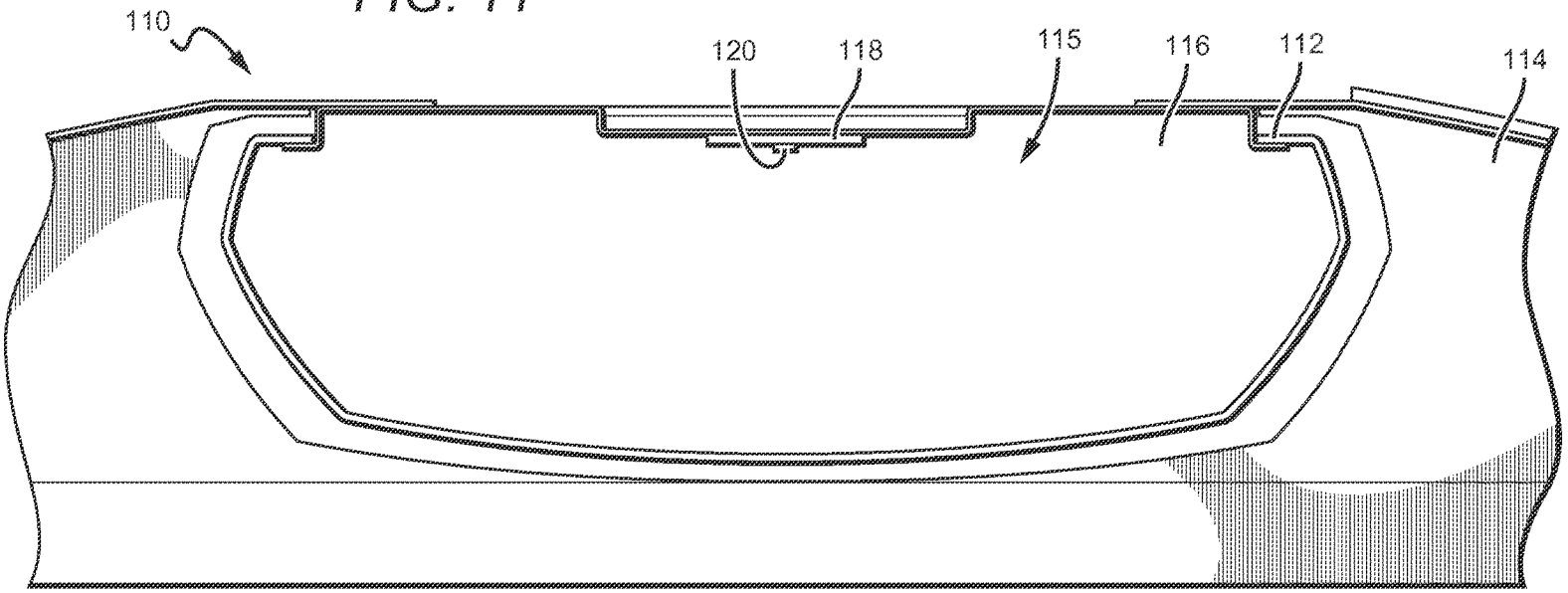
FIG. 11 is a partial side view of a fixture according to an embodiment of the present disclosure.
Figure 12:
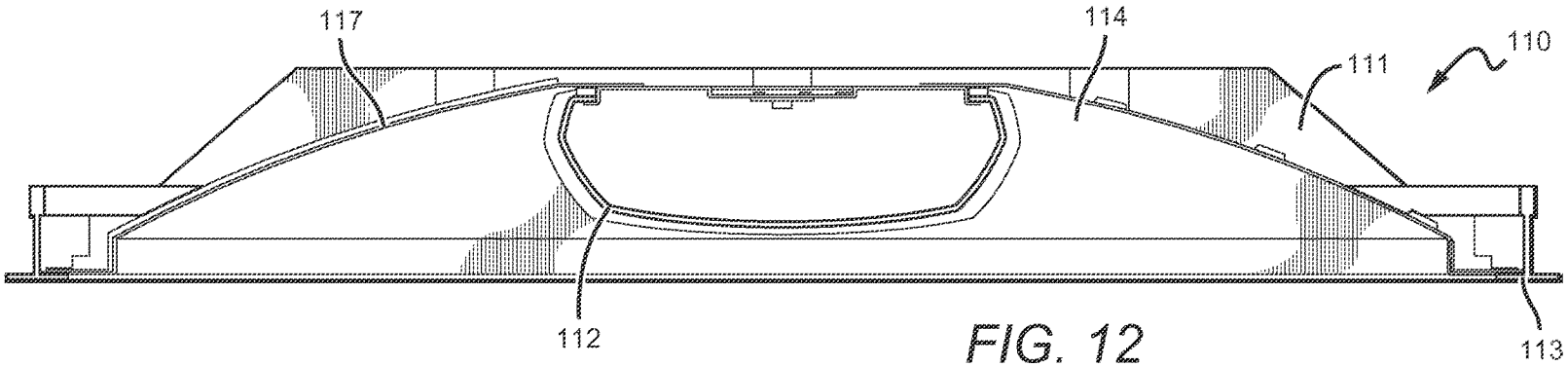
FIG. 12 is a full side view of the fixture of FIG. 11.

FIGS. 11 and 12 are additional side views of a fixture 110 according to the present disclosure. FIG. 11 is a close up view of the fixture 110 shown in FIG. 12. FIG. 11 shows a lens 112, which defines an interior compartment 115. End reflector 114 surrounds the lens 112 and compartment 115. An end cap 116 may also define a portion of the interior compartment. The interior of the lens also includes light board 118 with associated light emitters 120. FIG. 12 shows the fixture 110 installed or mounted within a pan 111 that is in a T grid 113. As shown, the fixture 110, which includes back reflector 117, lens 112, and end reflector 114, is placed between the T grid 113 and pan 111.

The troffer fixture may be mounted within a T grid by being placed on the T grid or sandwiched between an existing pan and a T grid. In other embodiments, additional attachments, such as tethers, may be included to stabilize the fixture in case of earthquakes or other disturbances. A tether may be installed after the fixture is put in place and before the second portion of the back reflector is put in place.

The lighting schemes shown in the figures are meant to be exemplary. Thus, it is understood that many different dimensions of light emitter, lens, and reflector combinations can be used to generate a desired output and light color.

It is understood that embodiments presented herein are meant to be exemplary. Embodiments of the present invention can comprise any combination of compatible features shown in the various figures, and these embodiments should not be limited to those expressly illustrated and discussed. Many other versions of the configurations disclosed herein are possible. Thus, the spirit and scope of the invention should not be limited to the versions described above.

We claim:

1. A light fixture, comprising:
a plurality of light sources;
a lens over said plurality of light sources;
first and second end reflectors, wherein at least one of said end reflectors fits around said lens such that it is movable along said lens; and
at least one movable back reflector between said first and second end reflectors.

2. The fixture of claim 1, wherein said back reflector comprises at least two reflectors, wherein a first of said back reflectors is on a first side of said plurality of light sources and a second of said back reflectors is on a second opposite side of said plurality of light sources.

3. The fixture of claim 2, wherein at least one of said first and second back reflectors is stationary.

4. The fixture of claim 1, wherein said movable end reflector can slide along said lens.

5. The fixture of claim 1, wherein said back reflector has a white reflective surface.

6. The fixture of claim 1, wherein said end reflector has a white reflective surface.

7. The fixture of claim 1, wherein a portion of said lens allows light to pass through and at least another portion of said lens is reflective.

8. The fixture of claim 1, further comprising a light board, wherein said plurality of light sources are on said light board and wherein said light board is removably attached to said lens.

9. The fixture of claim 1, wherein a portion of said lens comprises an interior compartment and said interior compartment is separated by a barrier from the remainder of the interior of said lens.

10. The fixture of claim 9, wherein a driver circuit is housed in said interior compartment.

11. The fixture of claim 9, further comprising a circuit isolation structure in said interior compartment.

12. The fixture of claim 1, further comprising at least one end cap at an end of said lens, said end cap defining an interior compartment for housing electronic components.

13. A light fixture, comprising:
first and second end reflectors, wherein at least one of said end reflectors is configured to define an interior compartment;
at least one back reflector between said first and second end reflectors;
a plurality of light sources, wherein said plurality of light sources are oriented to output light in the same direction as said fixture; and
a lens over said plurality of light sources, wherein at least one of said end reflectors is movable along said lens.

14. The fixture of claim 13, wherein said plurality of light sources are between said first and second end reflectors.

15. The fixture of claim 13, wherein said back reflector comprises at least two back reflectors, wherein a first of said back reflectors is on a first side of said plurality of light sources and a second of said back reflectors is on a second opposite side of said plurality of light sources.

16. The fixture of claim 13, wherein said movable end reflector can slide along said lens.

17. The fixture of claim 13, wherein said lens has uniform diffusion properties.

18. The fixture of claim 13, wherein a driver circuit is housed in said interior compartment.

19. The fixture of claim 13, further comprising a light board, wherein said plurality of light sources are on said light board and wherein said light board is removably attached to said fixture, wherein said back reflector is angled such that it is not parallel to said light board.

20. The fixture of claim 13, wherein said plurality of light sources are distributed within a plurality of light emitter clusters, each cluster comprising discrete light emitters, such that each light emitter within a cluster is spaced a first distance from other light emitters within a cluster, and each cluster is spaced a second distance from other clusters.

21. The fixture of claim 13, wherein said plurality of light sources are evenly distributed.

22. A light fixture, comprising:

a first and second component, wherein said first component comprises:

first and second end reflectors;

a first back reflector between said first and second end reflectors;

a plurality of light sources, wherein said plurality of light sources are oriented to output light in the same direction as said fixture; and a lens over said plurality of light sources, wherein at least one of said end reflectors fits around said lens such that it is movable along said lens; and wherein said second component comprises a second back reflector and wherein said second component is removably attached to said first component.

23. The fixture of claim 22, wherein said movable end reflector can slide longitudinally along said lens.

24. The fixture of claim 22, wherein said movable end reflector can rotate along said lens.

25. The fixture of claim 22, wherein light emitted from said plurality of light sources must pass through said lens to exit said fixture.

26. The fixture of claim 22, wherein said back reflector is configured to have a shape which is not planar.

27. The fixture of claim 1, wherein said movable end reflector can rotate about said lens.

28. The fixture of claim 13, wherein said movable end reflector can rotate about said lens.

* * * * *